US006406565B1

(12) United States Patent
Hashimura et al.

(10) Patent No.: US 6,406,565 B1
(45) Date of Patent: Jun. 18, 2002

(54) HIGH TOUGHNESS SPRING STEEL

(75) Inventors: Masayuki Hashimura; Hiroshi Hagiwara; Takanari Miyaki; Toshio Banno, all of Muroran (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/686,032

(22) Filed: Oct. 11, 2000

Related U.S. Application Data

(63) Continuation-in-part of application No. 09/214,378, filed as application No. PCT/JP98/02027 on May 7, 1998, now abandoned.

(30) Foreign Application Priority Data

May 12, 1997 (JP) ..... 9-120508
Feb. 17, 1998 (JP) ..... 10-34578

(51) Int. Cl.[7] ..... C22C 38/28; C22C 38/32

(52) U.S. Cl. ..... 148/333; 148/330; 148/334; 148/335; 148/336; 148/908

(58) Field of Search ..... 148/908, 580, 148/333, 330, 334, 335, 336; 420/104, 106, 110, 109, 121, 112, 83

(56) References Cited

U.S. PATENT DOCUMENTS 5,776,267 A 7/1998 Namba et al. ..... 148/908

FOREIGN PATENT DOCUMENTS

| | | |
|---|---|---|
| JP | 1-87749 | 3/1989 |
| JP | 10-87749 | 3/1989 |
| JP | 5-51693 | 3/1993 |
| JP | 10-196697 | 7/1998 |

*Primary Examiner*—Deborah Yee
(74) *Attorney, Agent, or Firm*—Kenyon & Kenyon

(57) ABSTRACT

The present invention provides a spring steel showing a sufficient reduction in area and an impact toughness while the steel has a high strength, in particular a tensile strength as high as at least 1,500 Mpa. A high toughness spring steel according to the present invention comprises, based on mass, 0.45 to 0.85% of C, 0.9 to 2.5% of Si, 0.1 to 1.2% of Mn, 0.1 to 2.0% of Cr, 0.005 to 0.07% of Ti, 0.001 to 0.007% of N, the Ti content being greater than four times the N content in terms of percent by mass, 0.0005 to 0.0060% B, at least one of 0.0005 to 0.01% Mg, 0.0005 to 0.01% La, and 0.0005 to 0.01% Ce, P and S with restrictive contents of less than 0.020% and less than 0.020%, respectively, and the balance of Fe and unavoidable impurities, and selectively contains V, Nb, Ni, Mo and Cu. The percent area of oxides and sulfides is not more than 0.1%.

13 Claims, 12 Drawing Sheets

UNIT CYCLE INCLUDES 3hr SALT WATER SPRAYING PLUS 21 DAYS DRYING IN AIR.

HIGH TOUGHNESS SPRING STEEL

This application is a continuation-in-part of U.S. patent application Ser. No. 09/214,378 filed Jan. 6, 1999, now abandoned which was the National Stage of International Application No. PCT/JP98/02027 filed May 7, 1998. The disclosures of U.S. application Ser. No. 09/214,378 and International Application No. PCT/JP98/02027 are hereby expressly incorporated by reference.

FIELD OF THE INVENTION

The present invention relates to a spring steel used for high strength springs employed for automobiles, other industrial machines, and the like.

DESCRIPTION OF THE RELATED ART

As automobiles having a high performance have come to be produced, the springs used therein must be very strong, and a high strength steel having a tensile strength exceeding 150 kgf/mm$^2$ after heat treatment has been used for the springs. A steel having a tensile strength exceeding 200 kgf/mm$^2$ has also been used in recent years. Japanese Unexamined Patent Publication (Kokai) No. 57-32353 discloses a procedure wherein fine carbides which are brought into solid solution by quench-hardening and which are precipitated by tempering are formed in the steel by adding elements such as V, Nb and Mo, and the fine carbides limit the movement of dislocations and improve the resistance to setting.

However, it is important that a steel for springs has such a fracture property that the steel can withstand the harsh environment where the springs are used. In particular, it is well known that when the strength of the steel is increased, the impact toughness and the ductility thereof lower. The impact toughness of the steel disclosed in Japanese Unexamined Patent Publication (Kokai) No. 57-32353 is from 2.2 to 2.8 kgf-m/cm$^2$ as measured using a JIS No. 3 test piece. Therefore, it can be concluded that the steel can never have a sufficiently high toughness.

Fatigue property in a corrosive environment must be also considered from the view points of the pit formation and hydrogen absorption due to corrosion in addition to the usual factors facilitating fatigue in a dry environment. It is generally recognized that, similarly to impact toughness and elongation, the corrosion fatigue resistance is lowered with an increase in the steel strength and that no practically acceptable steels could be obtained if a conventional steel is strengthened by heat treatment alone.

DISCLOSURE OF THE INVENTION

An object of the present invention is to provide a steel material for springs having a high strength and a high toughness after heat treatment.

The present inventors have developed a steel having a sufficient ductility and a sufficient impact toughness, even when the steel is made to have a high strength, by refining austenite grains with precipitates which have never been observed in conventional spring steels, and extremely decreasing the impurities at austenite grain boundaries which tend to promote fracture.

The object as mentioned above can be attained by the present invention described below.

A first aspect of the present invention provides a high toughness spring steel comprising, based on mass, 0.35 to 0.85% of C, 0.9 to 2.5% of Si, 0.1 to 1.2% of Mn, 0.1 to 2.0% of Cr, 0.005 to 0.07% of Ti, 0.001 to 0.007% of N, the Ti content being greater than four times the N content in terms of percent by mass, P and S with restrictive contents of less than 0.020% and less than 0.020%, respectively, and the balance of Fe and unavoidable impurities.

A second aspect of the present invention provides a high toughness spring steel comprising, based on mass, 0.35 to 0.85% of C, 0.9 to 2.5% of Si, 0.1 to 1.2% of Mn, 0.1 to 2.0% of Cr, 0.005 to 0.07% of Ti, 0.0005 to 0.0060% of B, 0.001 to 0.007% of N, the Ti content being greater than four times the N content in terms of percent by mass, P and S in restrictive contents of less than 0.020% and less than 0.020%, respectively, and the balance of Fe and unavoidable impurities.

A third aspect of the present invention provides a high toughness spring steel further comprising, based on mass, one or two kinds of the following elements with the following contents: 0.05 to 0.5% of V and 0.01 to 0.10% of Nb, in addition to the elements defined in the first or the second aspect of the present invention.

A fourth aspect of the present invention provides a high toughness spring steel further comprising, based on mass, one or two kinds of the following elements with the following contents: 0.05 to 1.0% of Ni and 0.05 to 1.0% of Mo, in addition to the elements defined in the first or the second aspect of the present invention.

A fifth aspect of the present invention provides a high toughness spring steel further comprising, based on mass, one or two kinds of the following elements with the following contents: 0.05 to 0.5% of V and 0.01 to 0.10% of Nb, and one or two kinds of the following elements with the following contents: 0.05 to 1.0% of Ni and 0.05 to 1.0% of Mo, in addition to the elements defined in the first or the second aspect of the present invention.

A sixth aspect of the present invention provides a high toughness spring steel further comprising, based on mass, 0.05 to 0.3% of Cu, in addition to the elements defined in the first or the second aspect of the present invention.

A seventh aspect of the present invention provides a high toughness spring steel further comprising, based on mass, 0.05 to 0.5% of Cu and 0.05 to 1.0% of Ni, the Cu content being less than the Ni content in terms of percent by mass provided that the Cu content is greater than 0.3%, in addition to the elements defined in the first or the second aspect of the present invention.

An eighth aspect of the present invention provides a high toughness spring steel further comprising, based on mass, one or two kinds of the following elements with the following contents: 0.05 to 0.5% of V and 0.01 to 0.10% of Nb, in addition to the elements defined in the sixth or the seventh aspect of the present invention.

A ninth aspect of the present invention provides a high toughness spring steel further comprising, based on mass, 0.05 to 1.0% of Mo, in addition to the elements defined in the sixth or the seventh aspect of the present invention.

A tenth aspect of the present invention provides a high toughness spring steel further comprising, based on mass, one or two kinds of the following elements with the following contents: 0.05 to 0.5% of V and 0.01 to 0.10% of Nb, and 0.05 to 1.0% of Mo, in addition to the elements defined in the sixth or the seventh aspect of the present invention.

In a further aspect, the present inventors found that addition of Mg, La and/or Ce refines and disperses coarse MnS or other sulfide and oxide inclusions to suppress formation of corrosion pits which provide the starting points for fatigue fracture, thereby ensuring a good corrosion fatigue property of springs.

The present inventors also found that addition of B mitigates the amount of P segregated on the prior austenite grain boundaries to further improve impact toughness and elongation in comparison with conventional steels in which the gross P amount was simply reduced.

According to the further aspect, there is provided a high toughness spring steel comprising, based on mass, 0.45 to 0.85% C, 0.9 to 2.5% Si, 0.1 to 1.2% Mn, 0.1 to 2.0% Cr, 0.005 to 0.07% Ti, 0.001 to 0.007 N, the Ti content being greater than four times the N content, 0.0005 to 0.0060% B, at least one of 0.0005 to 0.01% Mg, 0.0005 to 0.01% La and 0.0005 to 0.01% Ce, P and S with respective contents of less than 0.020% and 0.020%, and the balance of Fe and unavoidable impurities, and percent area of oxides and sulfides being not more than 0.1%.

The upper limits of the Mg, La and Ce contents are preferably 0.003%, 0.007% and 0.007%, respectively.

In addition to the above-mentioned basic constituents, the steel preferably further comprises one or two of 0.05 to 0.5% V and 0.01 to 0.10% Nb and/or one or two of 0.05 to 1.0% Ni and 0.05 to 1.0% Mo.

In addition to the basic constituents, the steel preferably further comprises either 0.05 to 0.3% Cu, or 0.05 to 0.5% Cu and 0.05 to 1.0% Ni with the Cu content being less than the Ni content provided that the Cu content is greater than 0.3%.

The above-mentioned Cu containing steel preferably further comprises one or two of 0.05 to 0.5% V and 0.01 to 0.10% Nb, and/or 0.05 to 1.0% Mo.

PREFERRED EMBODIMENTS OF THE INVENTION

Figure 1:
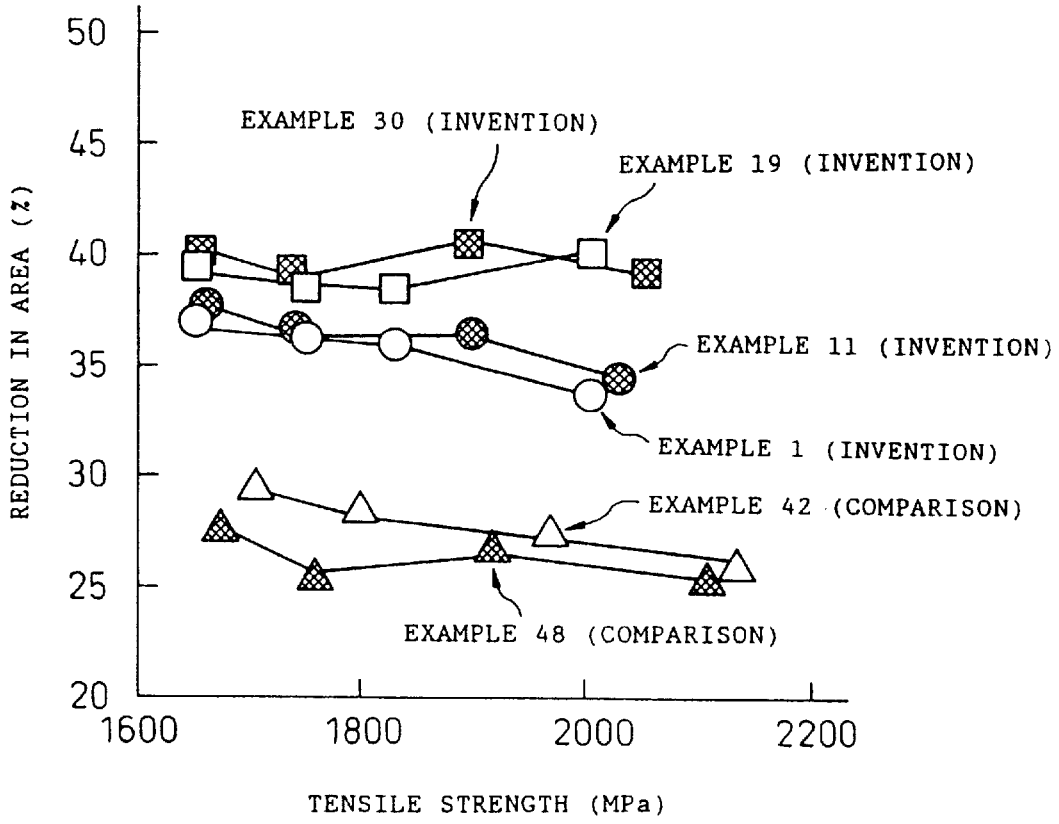
FIG. 1 is a graph showing the relationship between a tensile strength and a reduction in area.

The present inventors have achieved the invention of a steel wire excellent in high strength and impact toughness after quench-hardening and tempering while avoiding the use of large amounts of alloying elements as observed in many conventional technologies.

The reasons for restricting the chemical composition of the high toughness spring steel according to the present invention are as explained below.

C is an element which greatly influences the fundamental strength of the steel material. In order to obtain a sufficient strength of the steel, the C content is defined to be 0.35 to 0.85%. When the C content is less than 0.35%, a sufficient strength cannot be obtained, and large amounts of other alloying elements must be added. When the C content exceeds 0.85%, the steel becomes close to hypereutectoid, and the toughness of the steel is considerably lowered.

In a further aspect, the lower limit of the C content should be 0.45% to ensure further improved strength.

Si is an element necessary for ensuring the strength, the hardness and the resistance to setting of springs. When the Si content is small, a strength and a resistance to setting necessary for the steel become insufficient. Accordingly, the lower limit of the Si content is defined to be 0.9%. When an excessively large amount of Si is added, the steel material is not only hardened but also embrittled. Therefore, in order to prevent embrittlement of the steel after quench-hardening and tempering, the upper limit of the Si content is defined to be 2.5%.

In order to obtain a sufficient hardness of the steel, and suppress a decrease in the strength of the steel by fixing S present in the steel as MnS, the lower limit of the Mn content is defined to be 0.1%. In order to prevent embrittlement of the steel with Mn, the upper limit of the Mn content is defined to be 1.2%.

Cr is an element effective in improving the heat resistance and quench-hardenability of the steel. However, addition of Cr in a large amount not only increases the cost of the steel but also embrittles it so that cracks tend to be formed during wire drawing. Accordingly, in order to ensure the quench-hardenability of the steel, the lower limit of the Cr content is defined to be 0.1%. The upper limit thereof is defined to be 2.0% where the embrittlement becomes significant.

Ti hardens the steel to improve the strength. However, part of Ti precipitates in the steel as nitride and carbide. In particular, the precipitation temperature of nitride is high, and the nitride is already precipitated in the molten steel. The bonding strength of nitride is high, and Ti is used for fixing N in the steel. When B is to be added to the steel, Ti is added in an amount sufficient to fix N so that B is prevented from forming BN.

Furthermore, the precipitated nitride, carbide and carbonitride suppress austenite grain growth and refine austenite grains. However, when the addition amount is excessively large, the precipitates become too large, and exert adverse effects on the fracture property. The lower limit of the Ti content is defined to be 0.005% as a minimum addition amount necessary for fixing N and refining austenite grains. The upper limit of the Ti content is defined to be 0.07% as a maximum amount which does not exert adverse effects on the fracture property because of the precipitate size.

B is known as an element for improving the quench-hardenability of the steel. Moreover, B is effective in increasing the cleanliness of the austenite grain boundaries.

That is, addition of B makes nondetrimental such elements as P and S segregating at grain boundaries to lower the toughness, and as a result improves the fracture property. When B combines with N to form BN during the addition of B, the effect is ruined. The lower limit of the addition amount of B is defined to be 0.0005 from which the addition effect becomes definite. The upper limit thereof is defined to be 0.0060% at which the addition effect is saturated.

Most of N in a steel to which Ti is added forms TiN. TiN thus formed is not brought into solid solution at the subsequent austenitizing temperature. Formation of carbonitride, therefore, becomes easy, and the carbonitride tends to become precipitation sites of Ti-based precipitates which become pinning particles for refining austenite grains.

The pinning particles can, therefore, be stably formed under various conditions of heat treatments conducted until the springs are produced. In order to achieve such an object, N is added in an amount of at least 0.001%. In order to prevent the precipitation of coarse TiN so that the fracture property is not ruined, the upper limit of the addition amount of N is defined to be 0.007%.

Furthermore, the Ti content is defined to be greater than four times the N content in terms of percent by mass for reasons as explained below. Since it is difficult to control the strength of the steel with N by heat treatment, N must be surely precipitated as TiN. It is necessary that all N be fixed as TiN, and that fine carbides effective in refining austenite grains must then be formed with excessive Ti. In view of what is mentioned above, it is appropriate that the Ti content be greater than four times the N content in terms of percent by mass and the content relationship is thus defined. Precipitates formed by Ti addition have the effect of trapping hydrogen which attacks the steel in a corrosive environment, and the resistance to hydrogen-induced delayed fracture is also improved.

P hardens the steel, and segregates to embrittle the steel material. In particular, P segregated at austenite grain boundaries lowers the impact toughness of the steel, and induces delayed fracture when hydrogen attacks the steel. A low content of P is, therefore, preferred. In order to suppress the tendency of the steel toward becoming significantly embrittled, the P content is restricted to less than 0.020%.

S embrittles the steel when it is present therein, similarly to Si. The influence of S is extremely reduced by Mh. However, since MnS also takes the morphology of inclusions, the fracture property becomes poor. It is, therefore, desirable that the S content be decreased as much as possible. In order to suppress the adverse effect as much as possible, the S content is restricted to less than 0.020%.

Furthermore, when one or two kinds of the elements V and Nb are added, the effect of refining austenite grains synergizes, and the toughness can be increased stably. However, the effect of V cannot be recognized substantially when the addition amount is less than 0.05%, and coarse undissolved inclusions are formed to lower the toughness of the steel when the addition amount exceeds 0.5%.

Nb is similar to V in that the effect of adding Nb is substantially not recognized when the addition amount is less than 0.01%, and that Nb forms coarse undissolved inclusions to lower the toughness of the steel when the addition amount exceeds 0.10%. Moreover, the precipitates of V or Nb have the effect of trapping hydrogen which attacks the steel in a corrosive environment, and the resistance to hydrogen-induced delayed fracture is also improved.

Addition of Mo in an amount of 0.05 to 1.0% improves the quench-hardenability, and the steel can be highly strengthened stably by heat treatment. Since the resultant steel is excellent in resistance to tempering softening and shows no decrease in the strength even after tempering at high temperature, it is excellent in toughness and a hydrogen-induced delayed fracture property. It can, therefore, be concluded from a comparison between the steel containing Mo and a steel containing no Mo and having the same strength that the former steel is excellent in a fracture property in a corrosive environment because the former steel can be tempered at high temperature. No effect can be observed when the addition amount is less than 0.05%, and the effect is saturated when the amount exceeds 1.0%.

Addition of Ni in an amount of 0.05 to 1.0% improves the quench-hardenability of the steel, and the steel can be highly strengthened stably after heat treatment. Ni also has the effect of improving the corrosion resistance. Ni inhibits the formation of rust, and improves the fracture property of the steel in a corrosive environment. When Ni is added in an amount less than 0.05%, no effect of the addition is observed. When Ni is added in an amount exceeding 1.0%, the effect is saturated.

As regards Cu, addition of Cu prevents the decarburization of the steel. Since a decarburization layer shortens the fatigue life of the steel after forming springs, an effort has been made to reduce the decarburization layer as much as possible. When the decarburization layer of the steel becomes deep, the surface layer is removed by surface removal or peeling. Cu also has the effect of improving resistance to corrosion of the steel similarly to Ni.

Accordingly, the fatigue life of the springs can be extended and the peeling step can be omitted by suppressing the decarburization layer formation. Cu shows the effects of inhibiting decarburization and improving resistance to corrosion when Cu is added in an amount of at least 0.05%. As described later, addition of Cu in an amount exceeding 0.5% tends to cause embrittlement of the steel leading to rolling defect formation even when Ni is added. Accordingly, the lower limit and the upper limit of the addition amounts of Cu are defined to be 0.05% and 0.5%, respectively.

Addition of Cu substantially does not impair the mechanical properties of the steel at room temperature. However, when Cu is added in an amount exceeding 0.3%, the hot ductility of the steel is deteriorated and, as a result, cracks are formed sometimes on the billet surface during rolling.

It is, therefore, important to adjust an amount of Ni addition for preventing the cracking of the steel during rolling, so that the Cu content becomes less than the Ni content in terms of percentage in accordance with the addition amount of Cu. When Cu is added to the steel in an amount of up to 0.3%, rolling defects are not formed in the steel; therefore, control of the Ni addition amount for the purpose of preventing rolling defects is not necessary.

Mg, La and Ce are oxide formers and form oxides in a molten steel. The oxides are formed at temperatures higher than the temperature range in which MnS or other coarse oxide or sulfide inclusions (hereinafter also simply referred to as "MnS") form and are already formed and present in a molten steel when MnS forms. Therefore, oxides of Mg, La and Ce act as nuclei for forming MnS to control the size and distribution of MnS particles. Namely, oxides containing Mg, La and/or Ce are more finely dispersed in a molten steel than the usual oxides of Si and Al, so that MnS particles having nucleus of the oxides containing Mg, La and/or Ce are finely dispersed in a molten metal. Thus, addition of Mg, La and/or Ce refines MnS at the same S content.

Mg must be present in an amount of 0.0005% or more to provide the above-mentioned effect of refining MnS or other coarse oxide and sulfide inclusions. However, Mg forms coarse oxides when present in an amount of more than 0.01%. Therefore, the Mg content must be from 0.0005% to 0.01%. To ensure prevention of formation of the coarse oxides, the Mg content should preferably not be above 0.003%. Namely, a preferred Mg content range is from 0.0005 to 0.003%.

La must be present in an amount of 0.0005% or more to provide the above-mentioned effect of refining MnS or other coarse oxide and sulfide inclusions. However, La forms coarse oxides when present in an amount of more than 0.01%. Therefore, the La content must be from 0.0005% to 0.01%. To ensure prevention of formation of the coarse oxides, the La content should preferably not be above 0.007%. Namely, a preferred La content range is from 0.0005 to 0.007%.

Ce must be present in an amount of 0.0005% or more to provide the above-mentioned effect of refining MnS or other coarse oxide and sulfide inclusions. However, Ce forms coarse oxides when present in an amount of more than 0.01%. Therefore, the Ce content must be from 0.0005% to 0.01%. To ensure prevention of formation of the coarse oxides, the Ce content should preferably not be above 0.007%. Namely, a preferred Ce content range is from 0.0005 to 0.007%.

MnS or other coarse oxide and sulfide inclusions act as starting points of corrosion and facilitate formation of coarse corrosion pits having an adverse effect on the corrosion fatigue property. The percent area of the coarse inclusions must not be more than 0.1%. The coarse inclusions when present in a percent area of more than 0.1% facilitate formation of corrosion pits and reduce the corrosion fatigue resistance.

The "percent area of oxides and sulfides" herein referred to is determined by microscopic observation of a mirror finished section of a specimen at a magnification of 100 in which image processing is carried out to calculate the sum of the areas occupied by coarse oxides and sulfides larger than 1 $\mu$m in diameter in an observation field having an area of 11.3 $mm^2$. The magnification of 100 advantageously provides reliable and complete observation of coarse inclusions having diameters larger than lam, particularly about 10 $\mu$m or more, which are detrimental to the corrosion fatigue resistance through formation of coarse corrosion pits.

Fine inclusions smaller than 1 $\mu$m in diameter and having no substantial influence on the steel properties are advantageously ignored by the 100-magnification observation to avoid unessential data thereby ensuring good reliability of the calculated value of the percent area of oxides and sulfides which are coarse and have substantial influence on the steel properties, particularly the corrosion fatigue property.

Although oxides and sulfides are observed for calculation, the obtained value substantially reflects that of MnS or other sulfides because oxide inclusions are smaller than sulfides in the spring steel of the present invention. TiN or other rectangular particles larger than about 10 $\mu$m are omitted from calculations.

EXAMPLES

Table 1 shows the chemical composition of each of the steels of the present invention. Table 2 shows the tensile strength, the reduction in area, the impact toughness, the Ti/N ratio, etc. of the steel having a chemical composition shown in Table 1. Table 3 shows the chemical composition of each of the comparative steels. Table 4 shows the tensile strength, the reduction in area, the impact toughness, the Ti/N ratio, etc. of the steel having a chemical composition shown in Table 3.

Steels used in most of the examples of the present invention were prepared by refining molten steels in a 200-ton converter, and continuous-casting the molten steels into billets. Moreover, steels in some of the examples (Examples 5, 9, 11 and 40) were melted in a 2-ton vacuum melting furnace.

A molten steel prepared by a converter was continuous-cast to give a slab. An ingot was prepared from a molten steel having been prepared in a 2-ton vacuum melting furnace. The slab and the ingot were bloomed to give billets, which were quench-hardened, tempered, and machined to give various test pieces. Table 5 shows the details. Oil quenching at 60° C. and air cooling related to the heat treatment conditions are designated below as OQ and AC, respectively.

The test pieces used for measuring the tensile strength, the reduction in area and the impact toughness shown in Tables 2 and 4 were heat treated under the following conditions. The test pieces were quenched by holding them at 900° C. for 15 minutes and subjecting them to OQ (oil quenching), and the quenched test pieces were tempered by holding them at 350° C. for 30 minutes and subjected to AC. All the test pieces in the examples and comparative examples had a tensile strength of about 1,900 MPa.

It has been confirmed that all the steels in the examples had a reduction in area of 30 to 40%, namely, a sufficient ductility, and an impact toughness as high as at least 4.0 kgf-m/$cm^2$. In contrast to the steels of the invention, the steels of comparative examples (Examples 37 to 49) had a reduction in area of about 30% and an impact toughness of about 3.0 kgf-m/$cm^2$ at the most. That is, the steels of the comparative examples clearly showed low values, compared with the steels of the examples.

In addition, steels in Comparative Examples 50, 51 and 59 which demonstrated the influence of Cu contained Cu either as a combination of Cu and Ni in amounts outside the scope of the present invention or as Cu alone in an amount outside the scope thereof. Consequently, the steels had low hot ductility, and reticulate cracks were formed on the surface of the steels during rolling. The resultant steel billets, therefore, had lower quality as spring steels, and evaluation of the mechanical properties of the steels was stopped.

Furthermore, in Examples 1, 11, 19, 30, 42 and 48, the reduction in area of test pieces of each steel was measured while the test pieces had strengths different from each other. The results are shown in FIG. 1. Steels of the examples (Examples 1, 11, 19 and 30) showed a stabilized reduction in area of 33 to 38% though they had strengths different from each other in the range of 1,600 to 2,200 MPa. However, in the comparative examples (Examples 42 and 48), the reduction in area of the test pieces gradually lowered as the strength became high, and even the highest reduction in area was as low as about 30% compared with that in the examples.

Figure 2:
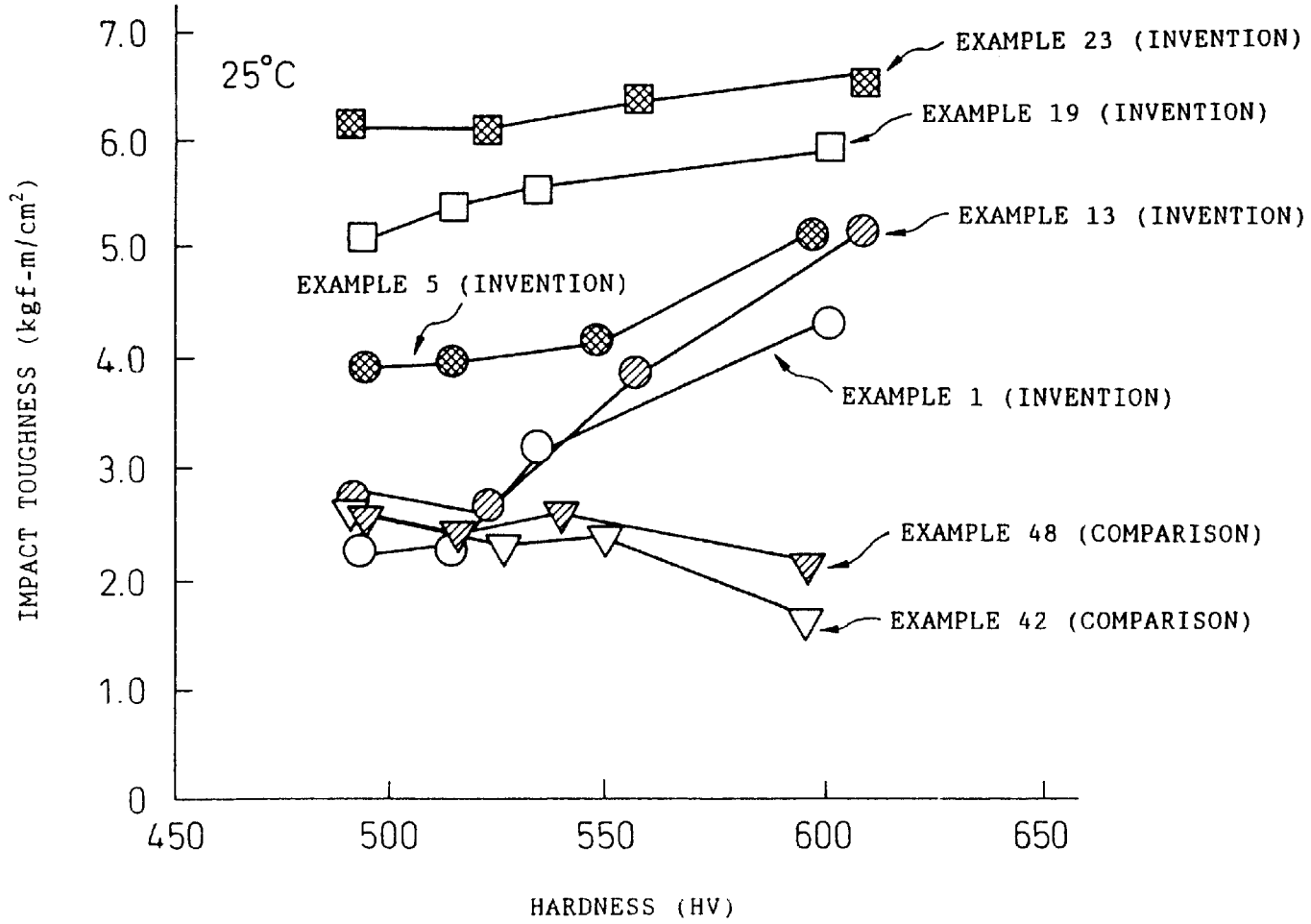
FIG. 2 is a graph showing the relationship between a hardness and an impact toughness.

FIG. 2 shows a comparison of impact toughness values of the steels having various hardness values in Examples 1, 5, 13, 19, 23, 42 and 48. The test pieces of the steels were heat treated under conditions shown in Table 5, and the hardness was varied by tempering temperature. Steels of the invention in examples (Examples 1, 5, 13, 19 and 23) showed an impact toughness as high as from 4.0 to 5.0 kgf-m/cm$^{22}$ even when the steels had a high hardness, namely, even when the steels were on the high strength side.

In Example 5 in which the contents of P and S of the steel were lowered, the steel had an impact toughness as high as from 4.0 to 5.0 kgf-m/cm$^2$ even when the steel was on the low strength side. In Examples 19 and 23 in which B was further added, the steels showed a stabilized impact toughness as high as at least 5.0 kgf-m/cm$^2$ at any hardness of the steels. In contrast to the examples mentioned above, in comparative examples (Examples 42 and 48), the steels showed an impact toughness of up to 3.0 kgf-m/cm$^2$ even when the steels had a low hardness and as a result showed a maximum impact toughness, and the impact toughness lowered further when the steels had a higher strength.

Figure 3:
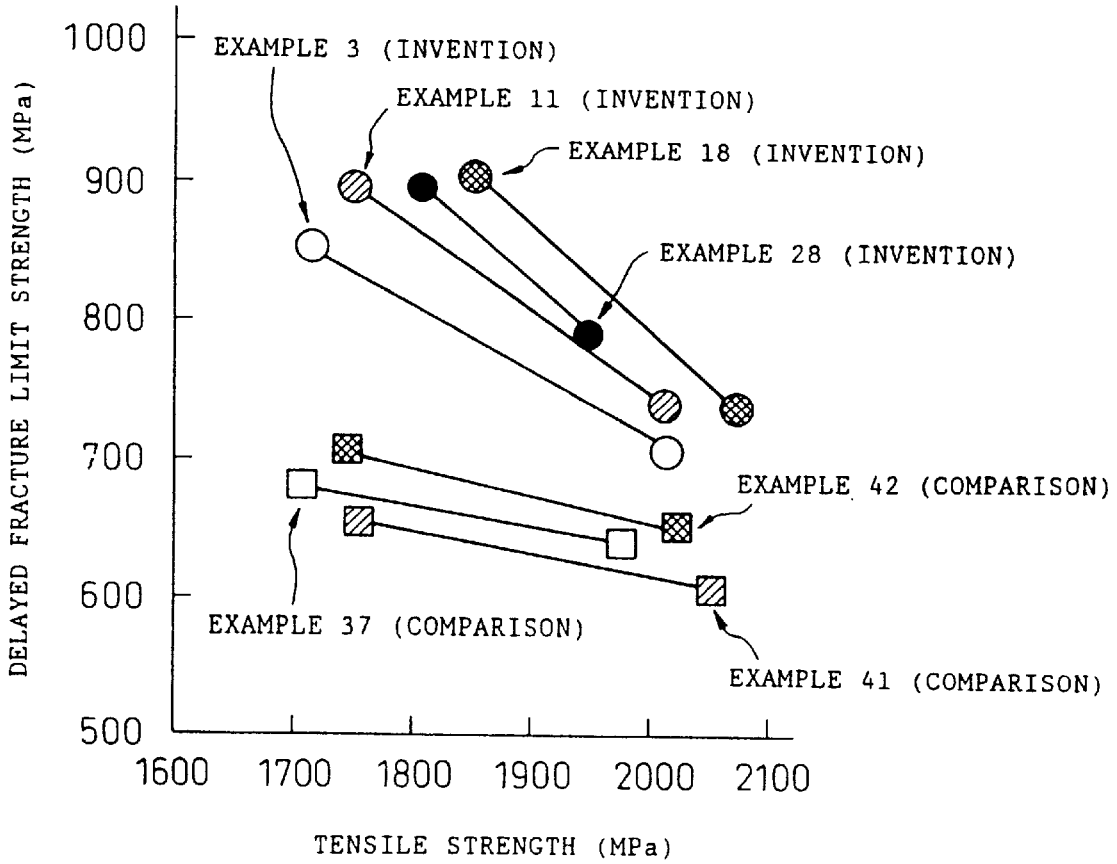
FIG. 3 is a graph showing the relationship between a tensile strength and a delayed fracture limit strength.

Furthermore, in Examples 3, 11, 18, 28, 37, 41 and 42, the resistance to hydrogen-induced delayed fracture was measured. The measurements were made by a hydrogen charged dead weight test, in which a constant load was applied to a test piece in an $H_2SO_4$ solution with pH 3 while hydrogen was charged to the test piece by applying a current thereto at a current density of 1.0 mA/cm$^2$; and a maximum applied stress at which no fracture occurred for 200 hours was defined as a delayed fracture limit strength. FIG. 3 shows the results of a tensile strength measured in the air and the delayed fracture limit strength.

Although the delayed fracture limit strength of a steel is influenced by the tensile strength, any of the steels in the examples showed a good delayed fracture property at any strength level for the following conjectured reasons. The steels in the examples had a fine austenite grain size, contained hydrogen trap sites in an increased amount, and had clean grain boundaries, compared with the steels in the comparative examples.

Figure 4:
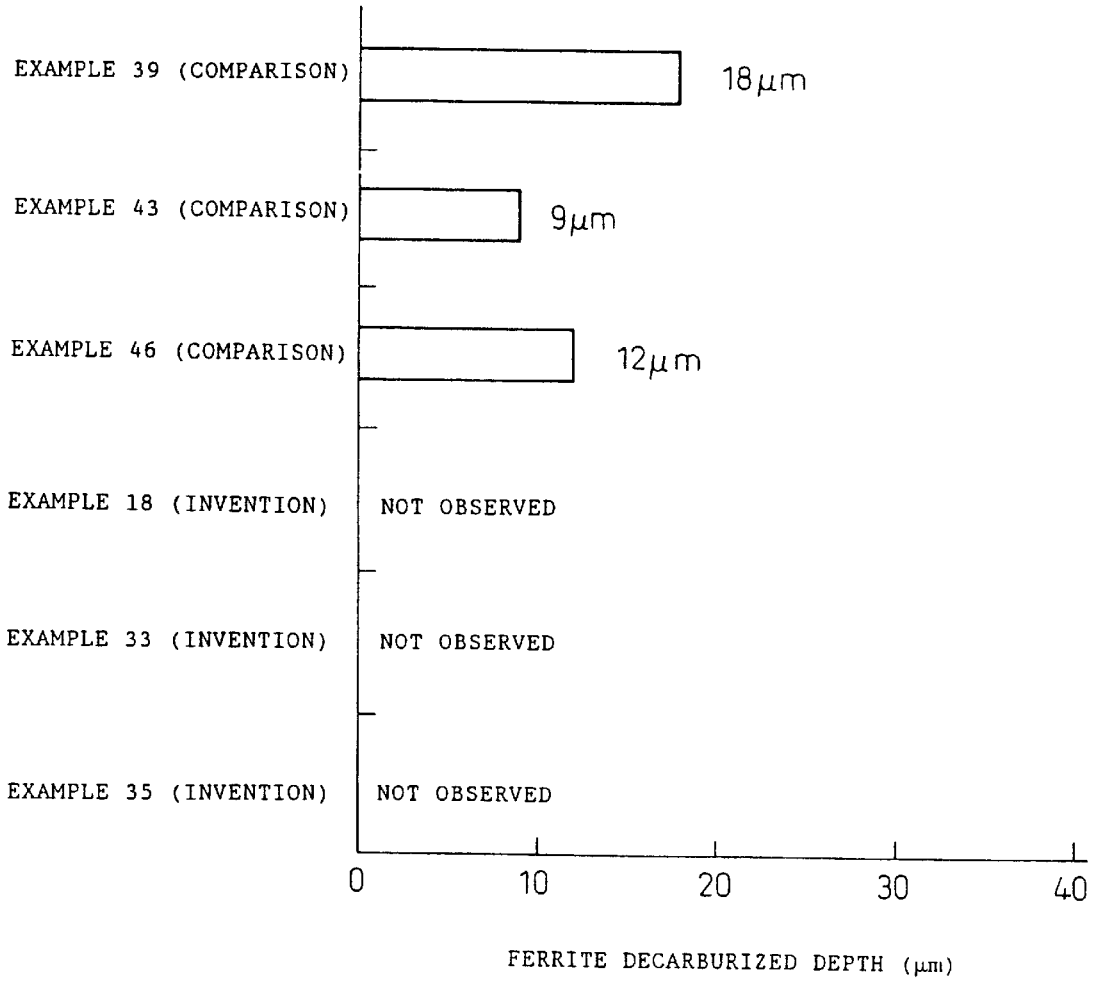
FIG. 4 is a graph showing the results of measuring a ferrite decarburized depth.

The effect of adding Cu is most significantly manifested in a decarburized layer. FIG. 4 shows the results of measuring a decarburized layer immediately after rolling in Examples 18, 33, 35, 39, 43 and 46. The test pieces were allowed to cool in the air immediately after rolling. The decarburized layer was measured by the following procedure. A test piece was cut in a direction normal to the rolling direction, and the cross-section was ground. The ground cross-section was etched with 2% nital so that the microstructure was manifested. The peripheral portion of the microstructure was observed with an optical microscope with a magnification of ×100. An area where at least three adjacent ferrite grains were present was defined as ferrite decarburization, and the depth was measured.

In Example 39 in which Cu was not added, ferrite decarburization about 20 $\mu$m in depth was recognized. On the other hand, in Examples 18, 33 and 35 in which Cu was added, decarburization is seen to have been inhibited. As explained above, addition of Cu improves the decarburization property of the steel, and as a result a spring steel excellent in productivity can be obtained.

TABLE 1

(mass %)

| Example | C | Si | Mn | P | S | Cr | Ti | B | N | V | Nb | Ni | Cu | Mo |
|---|---|---|---|---|---|---|---|---|---|---|---|---|---|---|
| Inventive 1 | 0.58 | 1.70 | 0.74 | 0.012 | 0.011 | 0.69 | 0.023 | — | 0.0041 | — | — | — | — | — |
| Inventive 2 | 0.47 | 1.52 | 0.74 | 0.011 | 0.010 | 1.02 | 0.025 | — | 0.0034 | — | — | — | — | — |
| Inventive 3 | 0.55 | 1.54 | 0.75 | 0.011 | 0.009 | 0.80 | 0.052 | — | 0.0035 | — | — | — | — | — |
| Inventive 4 | 0.60 | 1.96 | 0.75 | 0.010 | 0.010 | 0.98 | 0.025 | — | 0.0033 | — | — | — | — | — |
| Inventive 5 | 0.59 | 1.61 | 0.79 | 0.008 | 0.006 | 0.74 | 0.023 | — | 0.0021 | — | — | — | — | — |
| Inventive 6 | 0.63 | 1.48 | 0.91 | 0.010 | 0.005 | 0.61 | 0.021 | — | 0.0031 | — | — | — | — | — |
| Inventive 7 | 0.62 | 1.80 | 0.31 | 0.007 | 0.013 | 0.58 | 0.022 | — | 0.0044 | — | — | — | — | — |
| Inventive 8 | 0.59 | 2.01 | 0.65 | 0.009 | 0.012 | 0.99 | 0.025 | — | 0.0033 | — | — | — | — | — |
| Inventive 9 | 0.50 | 1.52 | 0.56 | 0.012 | 0.011 | 0.72 | 0.020 | — | 0.0022 | — | — | — | — | — |
| Inventive 10 | 0.48 | 1.77 | 0.79 | 0.012 | 0.009 | 0.75 | 0.020 | — | 0.0029 | — | — | — | — | — |
| Inventive 11 | 0.62 | 1.99 | 0.71 | 0.008 | 0.012 | 0.74 | 0.022 | — | 0.0035 | 0.21 | — | — | — | — |
| Inventive 12 | 0.58 | 2.01 | 0.75 | 0.010 | 0.010 | 0.76 | 0.022 | — | 0.0034 | — | 0.041 | — | — | — |
| Inventive 13 | 0.53 | 1.52 | 0.35 | 0.011 | 0.008 | 0.29 | 0.022 | — | 0.0038 | — | — | 0.42 | — | — |
| Inventive 14 | 0.71 | 1.53 | 0.66 | 0.011 | 0.007 | 0.51 | 0.021 | — | 0.0033 | — | — | — | — | 0.25 |
| Inventive 15 | 0.47 | 1.56 | 0.78 | 0.009 | 0.006 | 0.97 | 0.023 | — | 0.0035 | — | — | 0.31 | 0.22 | — |
| Inventive 16 | 0.57 | 1.72 | 0.75 | 0.010 | 0.009 | 0.48 | 0.025 | — | 0.0032 | — | 0.022 | 0.42 | — | — |
| Inventive 17 | 0.59 | 1.50 | 0.81 | 0.010 | 0.007 | 0.97 | 0.021 | — | 0.0042 | 0.10 | — | 0.21 | 0.13 | — |
| Inventive 18 | 0.53 | 1.52 | 0.35 | 0.011 | 0.008 | 0.29 | 0.024 | — | 0.0033 | 0.01 | — | 0.25 | 0.12 | 0.10 |
| Inventive 19 | 0.57 | 1.51 | 0.76 | 0.012 | 0.013 | 0.72 | 0.022 | 0.0022 | 0.0040 | — | — | — | — | — |
| Inventive 20 | 0.45 | 1.62 | 0.77 | 0.013 | 0.012 | 1.55 | 0.025 | 0.0024 | 0.0033 | — | — | — | — | — |
| Inventive 21 | 0.52 | 1.43 | 0.79 | 0.014 | 0.011 | 0.75 | 0.051 | 0.0019 | 0.0035 | — | — | — | — | — |
| Inventive 22 | 0.65 | 1.75 | 0.85 | 0.011 | 0.009 | 0.48 | 0.024 | 0.0024 | 0.0030 | — | — | — | — | — |
| Inventive 23 | 0.52 | 1.71 | 0.69 | 0.008 | 0.008 | 0.76 | 0.023 | 0.0020 | 0.0029 | — | — | — | — | — |
| Inventive 24 | 0.61 | 1.25 | 1.01 | 0.012 | 0.007 | 0.81 | 0.022 | 0.0022 | 0.0041 | — | — | — | — | — |
| Inventive 25 | 0.57 | 2.11 | 0.41 | 0.011 | 0.010 | 0.78 | 0.022 | 0.0022 | 0.0041 | — | — | — | — | — |
| Inventive 26 | 0.56 | 1.82 | 0.65 | 0.005 | 0.014 | 0.79 | 0.025 | 0.0025 | 0.0039 | — | — | — | — | — |
| Inventive 27 | 0.47 | 1.59 | 0.76 | 0.012 | 0.016 | 0.82 | 0.021 | 0.0031 | 0.0032 | — | — | — | — | — |
| Inventive 28 | 0.58 | 1.79 | 0.99 | 0.015 | 0.014 | 0.72 | 0.020 | 0.0020 | 0.0035 | — | — | — | — | — |
| Inventive 29 | 0.72 | 1.86 | 0.71 | 0.013 | 0.012 | 0.74 | 0.020 | 0.0022 | 0.0045 | 0.21 | — | — | — | — |
| Inventive 30 | 0.58 | 1.99 | 0.55 | 0.012 | 0.011 | 0.75 | 0.022 | 0.0024 | 0.0032 | — | 0.035 | — | — | — |
| Inventive 31 | 0.53 | 2.04 | 0.35 | 0.012 | 0.011 | 0.31 | 0.021 | 0.0025 | 0.0028 | — | — | 0.52 | — | — |
| Inventive 32 | 0.51 | 1.56 | 0.66 | 0.013 | 0.013 | 0.52 | 0.022 | 0.0023 | 0.0031 | — | — | — | — | 0.31 |
| Inventive 33 | 0.49 | 1.51 | 0.78 | 0.012 | 0.014 | 1.25 | 0.024 | 0.0022 | 0.0032 | — | — | 0.31 | 0.22 | — |

TABLE 1-continued

| Example | C | Si | Mn | P | S | Cr | Ti | B | N | V | Nb | Ni | Cu | Mo |
|---|---|---|---|---|---|---|---|---|---|---|---|---|---|---|
| | | | | | | | | | | | | | | (mass %) |
| Inventive 34 | 0.55 | 1.78 | 0.72 | 0.008 | 0.007 | 0.49 | 0.022 | 0.0028 | 0.0028 | — | 0.022 | 0.42 | — | — |
| Inventive 35 | 0.51 | 1.68 | 0.71 | 0.010 | 0.007 | 0.96 | 0.025 | 0.0025 | 0.0041 | 0.10 | — | 0.21 | 0.13 | — |
| Inventive 36 | 0.51 | 1.70 | 0.76 | 0.009 | 0.008 | 0.46 | 0.031 | 0.0030 | 0.0035 | 0.12 | — | 0.22 | 0.15 | 0.12 |
| Inventive 52 | 0.54 | 1.75 | 0.48 | 0.008 | 0.012 | 0.81 | 0.062 | 0.0029 | 0.0042 | — | — | — | — | — |
| Inventive 53 | 0.52 | 1.51 | 0.68 | 0.009 | 0.010 | 0.72 | 0.054 | 0.0025 | 0.0046 | — | — | — | 0.21 | — |
| Inventive 54 | 0.54 | 1.72 | 0.75 | 0.010 | 0.009 | 1.00 | 0.045 | 0.0021 | 0.0039 | 0.10 | — | — | 0.15 | — |
| Inventive 55 | 0.52 | 1.69 | 0.25 | 0.007 | 0.008 | 1.02 | 0.038 | 0.0022 | 0.0035 | — | 0.051 | — | 0.18 | — |
| Inventive 56 | 0.49 | 1.79 | 0.70 | 0.009 | 0.008 | 0.75 | 0.057 | 0.0026 | 0.0041 | — | — | — | 0.23 | 0.21 |
| Inventive 57 | 0.53 | 1.82 | 0.76 | 0.011 | 0.011 | 0.78 | 0.046 | 0.0022 | 0.0039 | 0.15 | 0.02 | — | 0.13 | — |
| Inventive 58 | 0.52 | 1.83 | 0.76 | 0.009 | 0.010 | 0.80 | 0.036 | 0.0021 | 0.0045 | — | 0.03 | — | 0.12 | 0.16 |

TABLE 2

| Example | Tensile strength (MPa) | Reduction in area (%) | Impact toughness (kgf-m/cm$^2$) | Ti/N (–) | Feature |
|---|---|---|---|---|---|
| Inventive | | | | | |
| 1 | 2005 | 35.5 | 4.2 | 5.61 | |
| 2 | 1896 | 35.1 | 4.5 | 7.35 | |
| 3 | 2010 | 35.7 | 4.8 | 14.9 | |
| 4 | 1973 | 33.5 | 5.2 | 7.58 | |
| 5 | 2094 | 32.0 | 5.1 | 11.0 | |
| 6 | 2016 | 32.7 | 4.4 | 6.77 | |
| 7 | 2087 | 33.5 | 5.5 | 5.00 | |
| 8 | 2018 | 36.3 | 5.9 | 7.58 | |
| 9 | 1935 | 36.6 | 5.1 | 9.09 | |
| 10 | 2045 | 32.6 | 5.1 | 6.90 | |
| 11 | 2009 | 36.0 | 5.0 | 6.29 | V |
| 12 | 2013 | 35.2 | 5.2 | 6.47 | Nb |
| 13 | 2115 | 32.5 | 5.2 | 5.79 | Ni |
| 14 | 2153 | 35.0 | 5.6 | 6.36 | Mo |
| 15 | 1886 | 36.0 | 5.4 | 6.57 | Cu, Ni |
| 16 | 1999 | 32.5 | 5.2 | 7.81 | Nb, Ni |
| 17 | 2005 | 36.0 | 5.4 | 5.00 | V, Cu, Ni |
| 18 | 2082 | 32.5 | 5.2 | 7.27 | V, Cu, Ni, Mo |
| 19 | 2002 | 38.2 | 5.8 | 5.50 | |
| 20 | 1897 | 39.1 | 5.5 | 7.58 | |
| 21 | 2001 | 37.7 | 5.8 | 14.6 | |
| 22 | 2131 | 38.5 | 6.2 | 8.00 | |
| 23 | 2085 | 42.0 | 6.5 | 7.93 | |
| 24 | 2086 | 38.7 | 5.4 | 5.37 | |
| 25 | 2078 | 37.5 | 5.2 | 5.50 | |
| 26 | 2165 | 42.3 | 5.9 | 6.41 | |

TABLE 2-continued

| Example | Tensile strength (MPa) | Reduction in area (%) | Impact toughness (kgf-m/cm$^2$) | Ti/N (–) | Feature |
|---|---|---|---|---|---|
| 27 | 1988 | 36.5 | 4.9 | 6.56 | |
| 28 | 1961 | 35.6 | 5.1 | 5.71 | |
| 29 | 2013 | 37.8 | 6.0 | 4.44 | V |
| 30 | 2021 | 40.2 | 6.2 | 6.88 | Nb |
| 31 | 1998 | 36.3 | 5.0 | 7.50 | Ni |
| 32 | 1996 | 39.0 | 5.1 | 7.10 | Mo |
| 33 | 2006 | 37.0 | 5.5 | 7.50 | Cu, Ni |
| 34 | 1986 | 33.5 | 6.2 | 7.86 | Nb, Ni |
| 35 | 1976 | 36.0 | 5.7 | 6.10 | V, Cu |
| 36 | 2106 | 32.5 | 5.2 | 8.86 | V, Cu, Mo |
| 52 | 2073 | 37.7 | 5.5 | 14.3 | |
| 53 | 1997 | 35.3 | 5.3 | 11.7 | Cu |
| 54 | 1985 | 37.2 | 4.6 | 11.5 | V, Cu |
| 55 | 2001 | 39.4 | 4.7 | 10.9 | Nb, Cu |
| 56 | 1996 | 40.2 | 4.5 | 13.9 | Cu, Mo |
| 57 | 2015 | 38.0 | 4.2 | 11.8 | V, Nb, Cu |
| 58 | 2043 | 37.6 | 4.4 | 8.0 | Nb, Cu, Mo |

Reduction in area and impact toughness were measured after the following heat treatment:

Quench-hardening: 900° C. × 15 min – OQ (oil quench) +

Tempering: 350° × 30 min – AC (air cool).

TABLE 3

| Example | C | Si | Mn | P | S | Cr | Ti | B | N | V | Nb | Ni | Cu | Mo |
|---|---|---|---|---|---|---|---|---|---|---|---|---|---|---|
| | | | | | | | | | | | | | | (mass %) |
| Comparative 37 | 0.58 | 2.01 | 0.75 | 0.026 | 0.014 | 0.73 | 0.024 | — | 0.0042 | — | — | — | — | — |
| Comparative 38 | 0.60 | 2.03 | 0.78 | 0.011 | 0.025 | 0.73 | 0.025 | — | 0.0043 | — | — | — | — | — |
| Comparative 39 | 0.54 | 1.98 | 0.79 | 0.015 | 0.011 | 0.77 | 0.050 | — | 0.0121 | — | — | — | — | — |
| Comparative 40 | 0.59 | 1.51 | 0.76 | 0.018 | 0.009 | 0.69 | 0.015 | — | 0.0030 | — | 0.212 | — | — | — |
| Comparative 41 | 0.60 | 1.57 | 0.76 | 0.007 | 0.010 | 0.77 | | 0.0029 | 0.0037 | 0.16 | — | — | — | — |
| Comparative 42 | 0.55 | 1.59 | 0.35 | 0.008 | 0.009 | 0.40 | — | — | 0.0045 | — | — | 0.49 | — | — |
| Comparative 43 | 0.59 | 1.51 | 0.75 | 0.035 | 0.016 | 0.76 | 0.024 | 0.0019 | 0.0040 | — | — | — | — | — |
| Comparative 44 | 0.61 | 1.52 | 0.78 | 0.013 | 0.033 | 0.75 | 0.025 | 0.0021 | 0.0040 | — | — | — | — | — |
| Comparative 45 | 0.59 | 1.53 | 1.01 | 0.021 | 0.013 | 1.02 | — | 0.0023 | 0.0040 | — | — | — | — | — |
| Comparative 46 | 0.53 | 1.78 | 0.79 | 0.016 | 0.015 | 0.68 | 0.048 | 0.0020 | 0.0110 | — | — | — | — | — |
| Comparative 47 | 0.59 | 1.85 | 0.74 | 0.018 | 0.012 | 0.72 | 0.011 | 0.0028 | 0.0050 | — | — | — | — | — |
| Comparative 48 | 0.58 | 1.81 | 0.76 | 0.009 | 0.008 | 0.75 | — | — | 0.0034 | 0.11 | — | — | — | — |
| Comparative 49 | 0.53 | 2.04 | 0.35 | 0.012 | 0.011 | 0.31 | — | — | 0.0041 | — | — | 0.55 | — | — |
| Comparative 50 | 0.55 | 1.51 | 0.70 | 0.008 | 0.009 | 0.45 | 0.026 | — | 0.0045 | — | — | — | 0.42 | — |
| Comparative 51 | 0.53 | 1.71 | 0.78 | 0.007 | 0.011 | 0.51 | 0.024 | 0.0019 | 0.0032 | — | — | 0.10 | 0.41 | — |
| Comparative 59 | 0.54 | 1.78 | 0.60 | 0.009 | 0.008 | 0.77 | 0.045 | 0.0025 | 0.0045 | 0.21 | — | — | 0.53 | — |

TABLE 4

| Example | Tensile strength (MPa) | Reduction in area (%) | Impact toughness (kgf-m/cm$^2$) | Ti/N (–) | Feature |
|---|---|---|---|---|---|
| Comparative | | | | | |
| 37 | 1995 | 24.3 | 2.5 | 5.71 | P > 0.020 |
| 38 | 2103 | 25.6 | 2.8 | 5.81 | S > 0.020 |
| 39 | 2056 | 23.3 | 2.1 | 4.13 | N > 0.007 |
| 40 | 2140 | 27.1 | 1.9 | 5.00 | Nb > 0.10 |
| 41 | 2056 | 23.2 | 2.8 | 0 | no Ti |
| 42 | 2020 | 27.2 | 1.8 | 0 | no Ti |
| 43 | 2132 | 22.5 | 2.1 | 6.00 | P > 0.020 |
| 44 | 2016 | 25.6 | 1.8 | 6.25 | S > 0.020 |
| 45 | 2154 | 25.4 | 2.2 | 0 | no Ti |
| 46 | 1968 | 19.8 | 2.0 | 4.36 | N > 0.007 |
| 47 | 1966 | 25.2 | 2.1 | 2.20 | Ti/N < 4 |
| 48 | 2103 | 26.2 | 2.2 | 0 | no Ti |
| 49 | 2033 | 27.0 | 2.6 | 0 | no Ti |
| 50 | — | — | — | 5.78 | Cu · cracking |
| 51 | — | — | — | 7.50 | Cu > Ni · cracking |
| 59 | — | — | — | 10.0 | Cu > 0.5 cracking |

Reduction in area and impact toughness were measured after the following heat treatment:
Quench-hardening: 900° C. × 15 min – OQ (oil quench) +
Tempering: 350° × 30 min – AC (air cool)

The tensile and impact test pieces had a common tensile strength of about 1900 MPa achieved by heat treatment conditions adjusted with the chemical compositions of the steels used and the basic conditions were a quench hardening by holding at 900° C. for 15 min followed by quenching in an oil held at 60° C. (OQ) and a tempering by holding at 400° C. for 30 min followed by air cooling (AC). The tempering temperatures were varied around 400° C. depending on the C contents of the samples to provide a substantially constant tensile strength of about 1900 MPa.

Figure 5A:
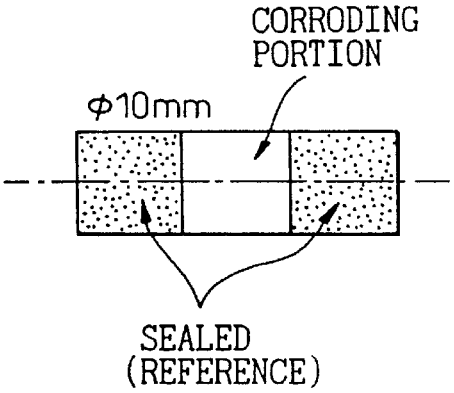
FIG. 5 shows a specimen for microscopic observation of corrosion pits, in (1) cross-sectional and (2) perspective views.
Figure 5B:
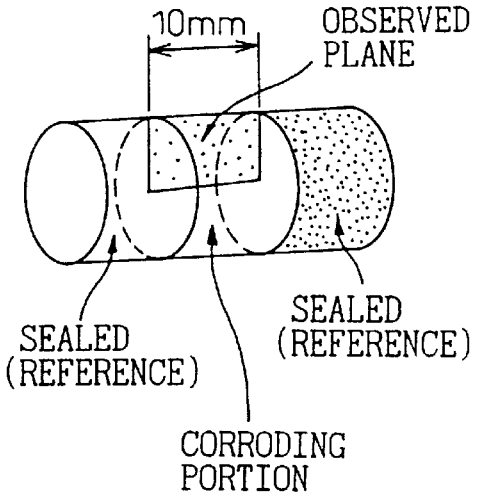

The addition of Mg, La and/or Ce influenced the formation of corrosion pits which influenced the corrosion fatigue behavior. FIG. 5 shows a specimen for microscopic observation of corrosion pits, in (1) cross-sectional and (2) perspective views. The specimen was in a round wire form having a diameter of 10 mm and a 10 mm long unsealed center portion exposed to a corrosive environment while end portions were sealed for protection from corrosion. The specimens were subjected a salt water spray test and, after the test, were cut at the center plane along the longitudinal direction for microscopic observation. The cutting was conducted after the specimens were embedded in a resin to prevent the cut edge of the specimen from being damaged during cutting, The cut surfaces were ground and polished to a mirror finish.

Figure 6:
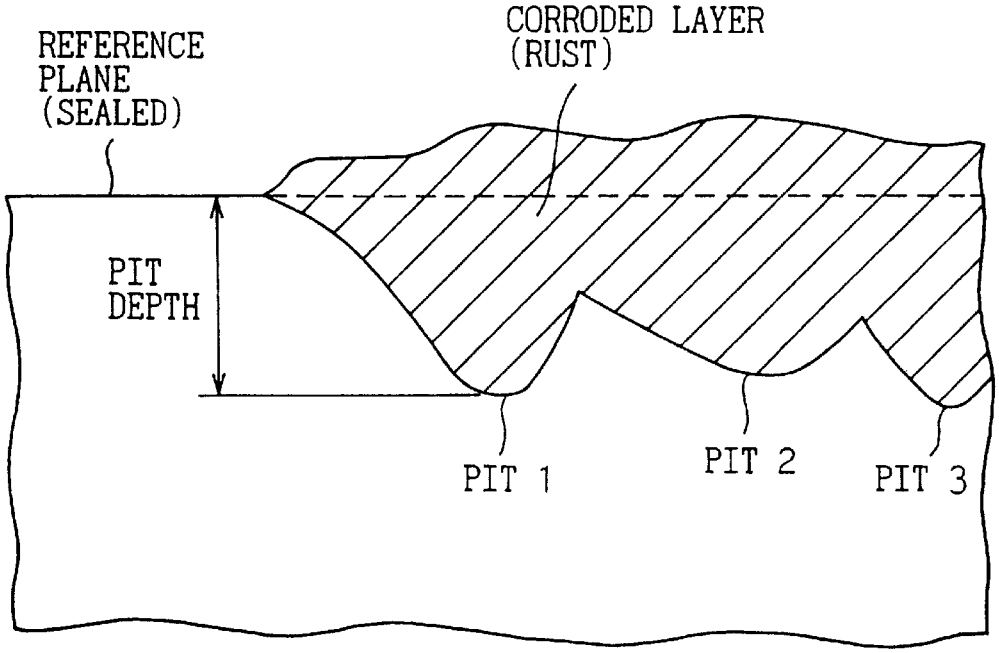
FIG. 6 is a schematic illustration of a partial cross-sectional of the specimen shown in FIG. 5 after corrosion test.

FIG. 6 is a schematic illustration of the mirror finished surface of the specimen observed in a microscope. The sealed portion remains uncorroded to provide a reference plane or line for measuring the depth of corrosion pits. The corroded profile included many corrosion pits including pit 1, pit 2, pit 3, and so on, and the depth was measured for all pits.

TABLE 5

| Step | Conditions | Note |
|---|---|---|
| Rolling | Heating 950–1250° C. 50–90 min<br>Coiling temp. 800–930° C.<br>Rolled size ϕ15–17 | Examples 18, 33: Heating/980° C., Coiling temperature/870° C.<br>Examples 35, 39: Heating/1020° C., Coiling temperature/850° C. |
| Heat treatment | Quench hardening 900° C. × 15 min → OQ<br>Tempering 300–500° C. × 30 min → AC | |
| Tensile test | Based on JIS Z 2241, Gauge ϕ9 min | Examples 1, 11, 30, 42, 48: Tensile strength adjusted by tempering temperature. |
| Impact test | Based on JIS Z 2242, JIS No. 3 charpy impact test, Testing temp.: 25° C. (room temp.) | Examples 1, 5, 13, 19, 23, 42, 48: Hardness adjusted by tempering temperature. |
| Delayed fracture test | Hydrogen charged, Dead weight test, Gauge ϕ8 mm, Notch depth 1 mm | Examples 3, 11, 18, 28, 37, 41, 42: Tensile strength adjusted by tempering temperature. |
| Decarburization measurement | Based on JIS G 0558 | Examples 18, 33, 35, 39, 43, 46: Ferrite decarburized depth measured. |

The following examples demonstrate the advantageous effect of the present invention, particularly the effect obtained by the addition of Mg, La and/or Ce and the limitation to the amount of coarse oxide and sulfide inclusions.

Tables 6 and 7 summarize the chemical compositions of the samples according to the present invention and the comparative samples outside the claimed range, respectively. Tables 8 and 9 summarize the tensile strength, the impact toughness, the delayed fracture strength, the fatigue life and the percent area of oxides and sulfides of the samples of Tables 6 and 7, respectively.

Most of the samples were produced by refining in a 200-ton converter and continuous casting to a strand or slab. The remaining samples were produced by melting in a 2-ton vacuum melting furnace and casting to an ingot. The slabs and the ingots were rolled to billets, hot-rolled, quench-hardened, tempered and machined to test pieces for various tests. The rolling and heat treating conditions are summarized in Table 10, in which the symbols "OQ" and "AC" mean "60° C. oil-quench" and "air cooling", respectively.

Figure 7:
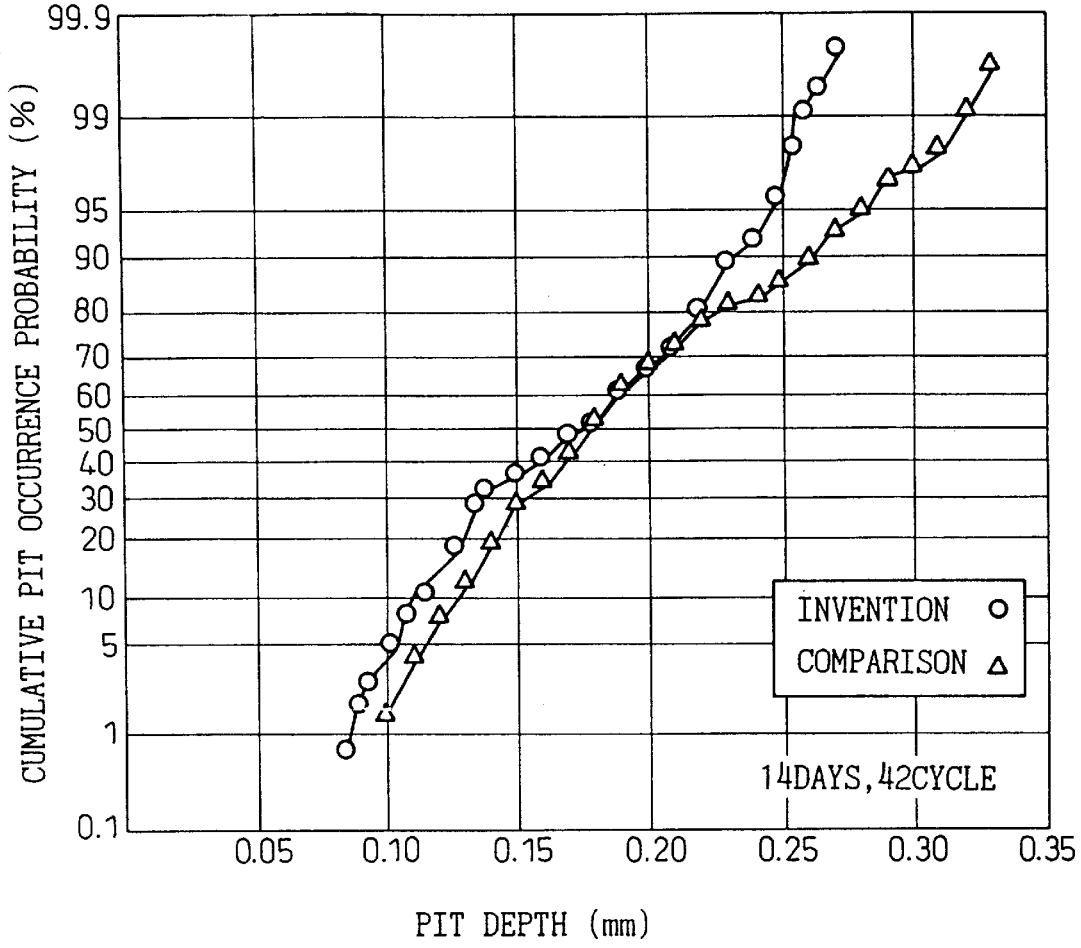
FIG. 7 is a graph showing the relationship between the pit depth and the cumulative pit occurrence probability.

FIG. 7 shows a typical Weibull plot of the measured pit depth data, in which the abscissa represents the pit depth and the ordinate represent the cumulative pit occurrence probability (CPOP). The data show that, at a CPOP of 99%, a difference in the pit depth of about 0.5 mm can be seen between the present inventive sample and the comparative sample, although no difference is observed at a CPOP of 50%. This shows that the comparative sample had deep pits in a greater number than that of the inventive sample.

Figure 8:
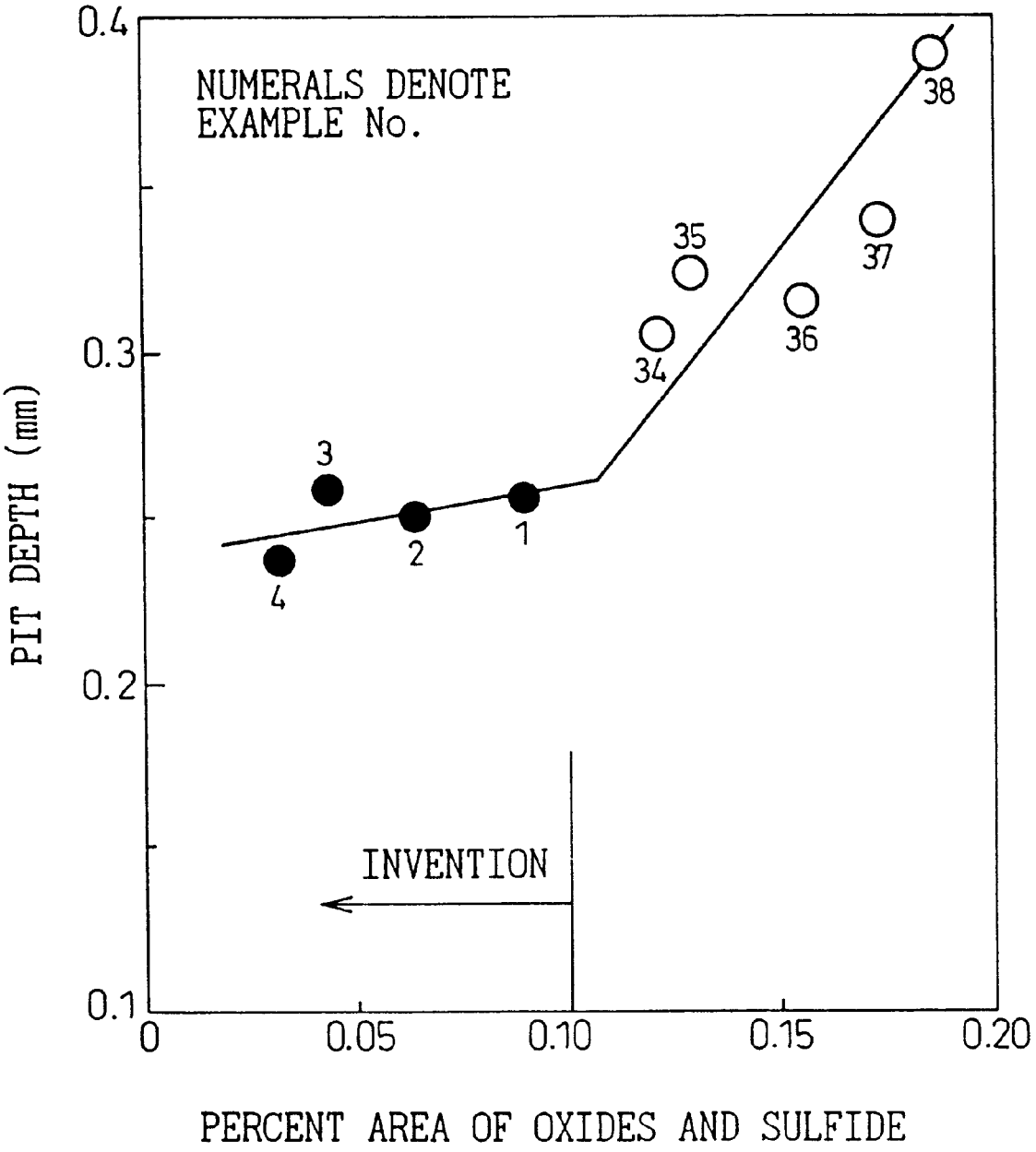
FIG. 8 is a graph showing the relationship between the percent area of oxides and sulfides and the pit depth.

FIG. 8 is a graph showing the relationship between the pit depth and the percent area of oxides and sulfides for the inventive samples No. 1 to 4 and the comparative samples No. 34 to 38, in which the pit depth was that at a CPOP of 99%, It can be seen from FIG. 8 that the pit depth is increased when the percent area of oxides and sulfides is more than 0.1%.

Figure 9:
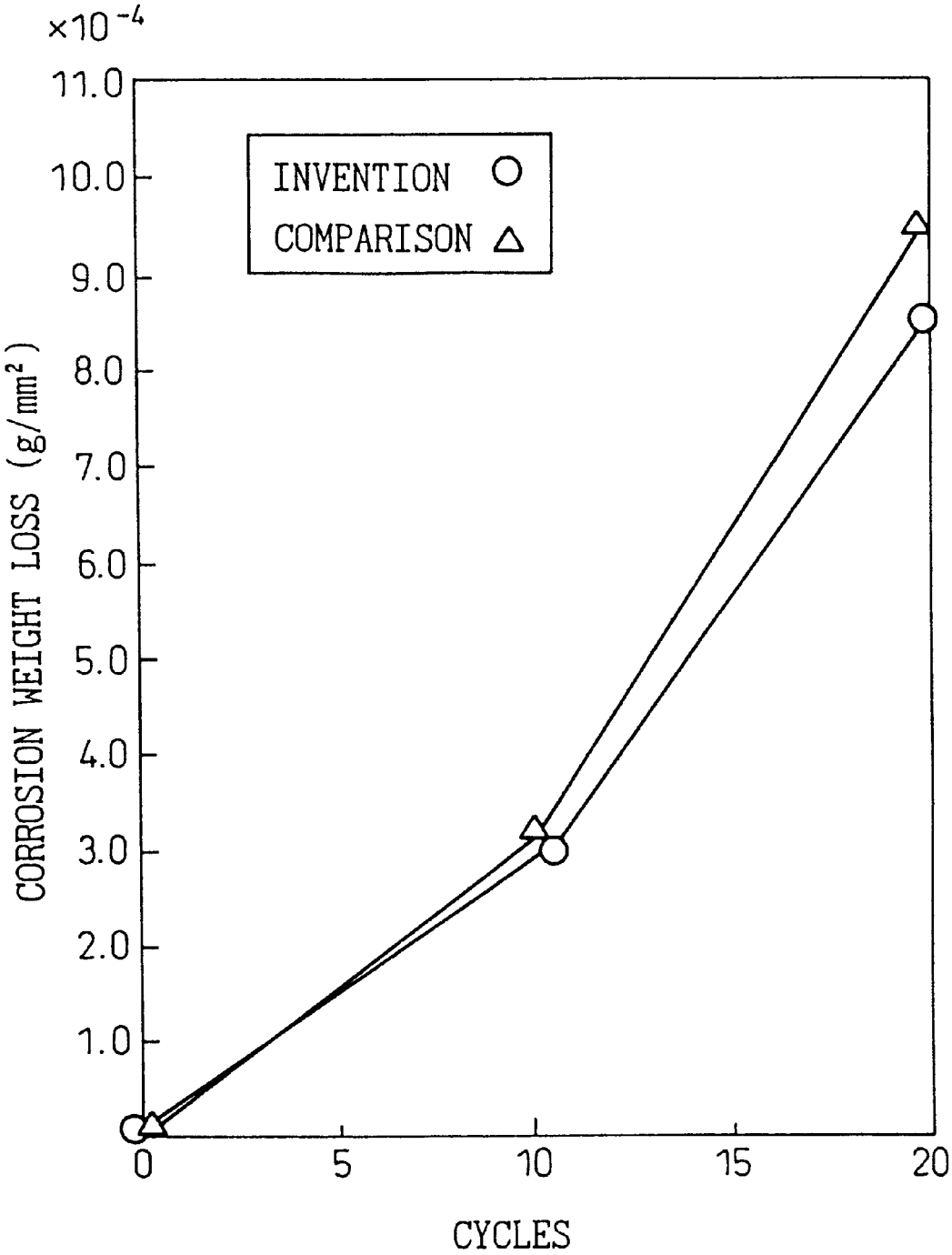
FIG. 9 is a graph showing the relationship between the corrosion test cycle and the corrosion weight loss.

FIG. 9 shows the corrosion weight loss for the inventive sample No, 2 and the comparative sample No. 34 as a function of the corrosion test cycle, in which the unit cycle includes a salt water spraying for 3 hours with the subsequent drying in air for 21 days. It can be seen from FIG. 9 that, after 20 cycles of corrosion test, the inventive sample exhibited a reduced corrosion weight loss in comparison with the comparative sample. This difference in the corrosion resistance influences the fatigue property.

Figure 10:
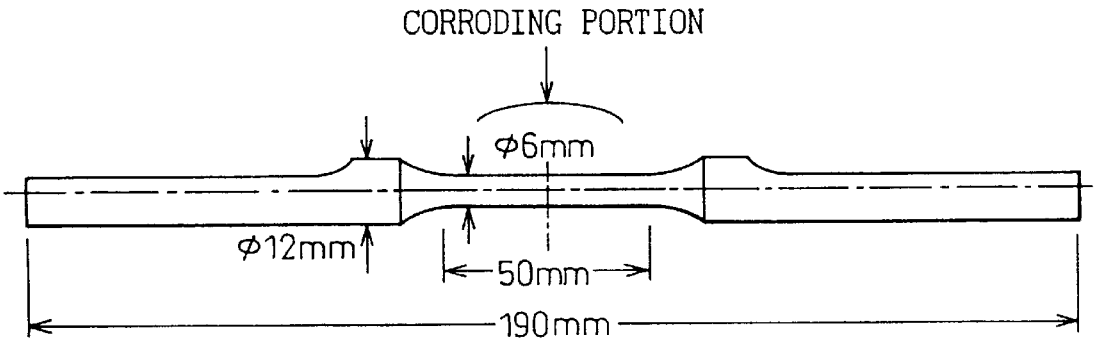
FIG. 10 shows a specimen for corrosion fatigue test in corrosive environment.

A twisting fatigue test was conducted using a test piece shown in FIG. 10, which had a 6 mm in dia. and 50 mm long gauge. Before the fatigue test, the gauge alone was subjected to a corrosion test of 20 cycles under the same corrosion condition as that mentioned above. As a reference, another test piece which had not corroded was also subjected to the fatigue test. The corroded test pieces were stored in a liquid nitrogen until they were subjected to the fatigue test, in order to keep the corroded condition unchanged and to prevent the hydrogen generated during corrosion from dispersing.

Figure 11:
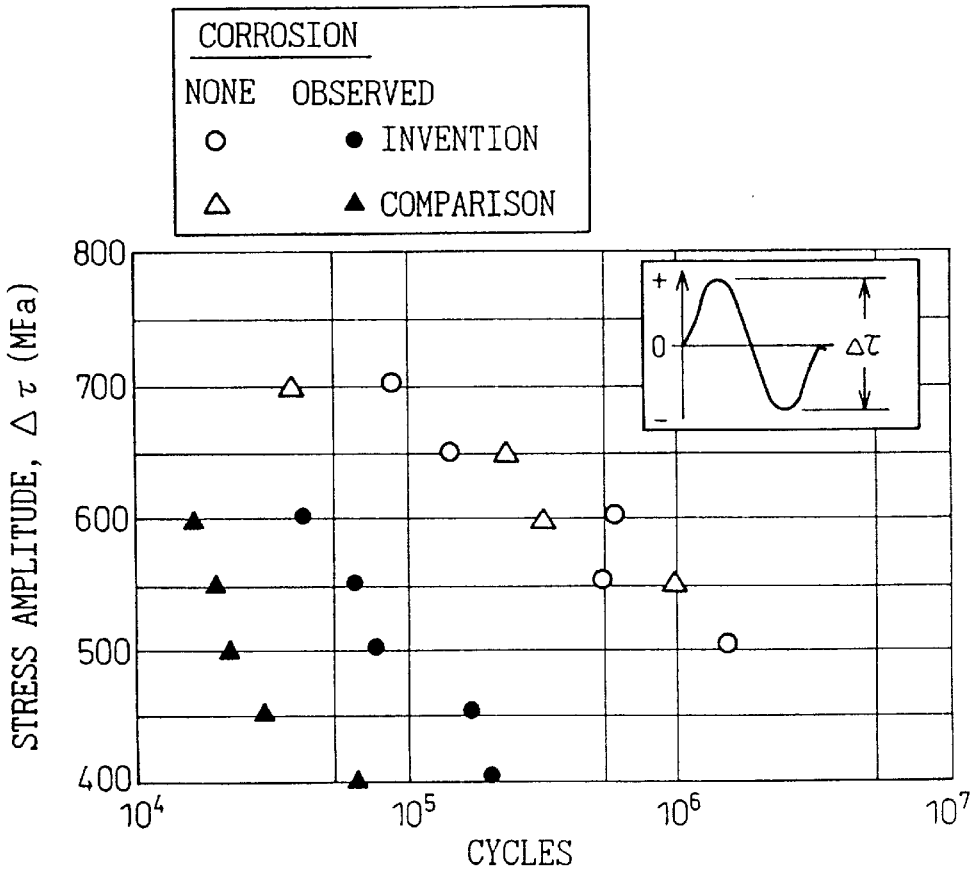
FIG. 11 is a graph showing the relationship between the corrosion test cycle and the stress amplitude.

FIG. 11 shows the fatigue behavior for the inventive sample No. 2 and the comparative sample No. 34 in corroded and uncorroded conditions. The uncorroded test pieces of samples No. 2 and No. 34 exhibited substantially the same fatigue behavior. In contrast, under the corroded condition, the inventive sample exhibited a fatigue life about two times that of the comparative sample at each level of the stress amplitude. Observation of the fatigue fracture surface showed that the fatigue fracture started from corrosion pits in all samples.

Figure 12:
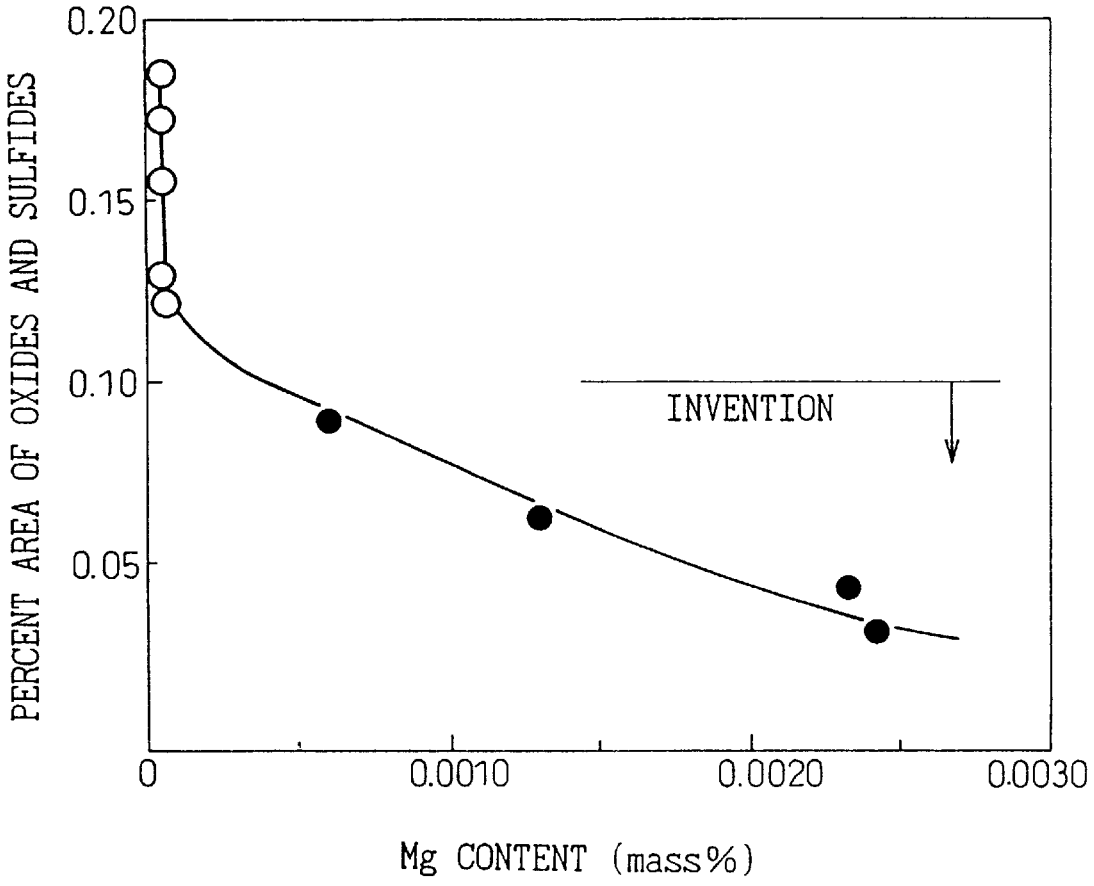
FIG. 12 is a graph showing the relationship between the Mg content and the percent area of oxides and sulfides.

FIG. 12 shows the relationship between the Mg content of steel and the percent area of oxide and sulfide inclusions. The solid circular plots represent the results of the inventive samples containing Mg in amounts within the specified range and the blank circular plots represent the results of the comparative samples not containing Mg. In the inventive samples, the percent area of oxides and sulfides is reduced as the Mg content is increased. This is not because the oxides and sulfides are eliminated but because the amount of coarse oxides and sulfides are reduced to result in the reduced observed values.

Figure 13:
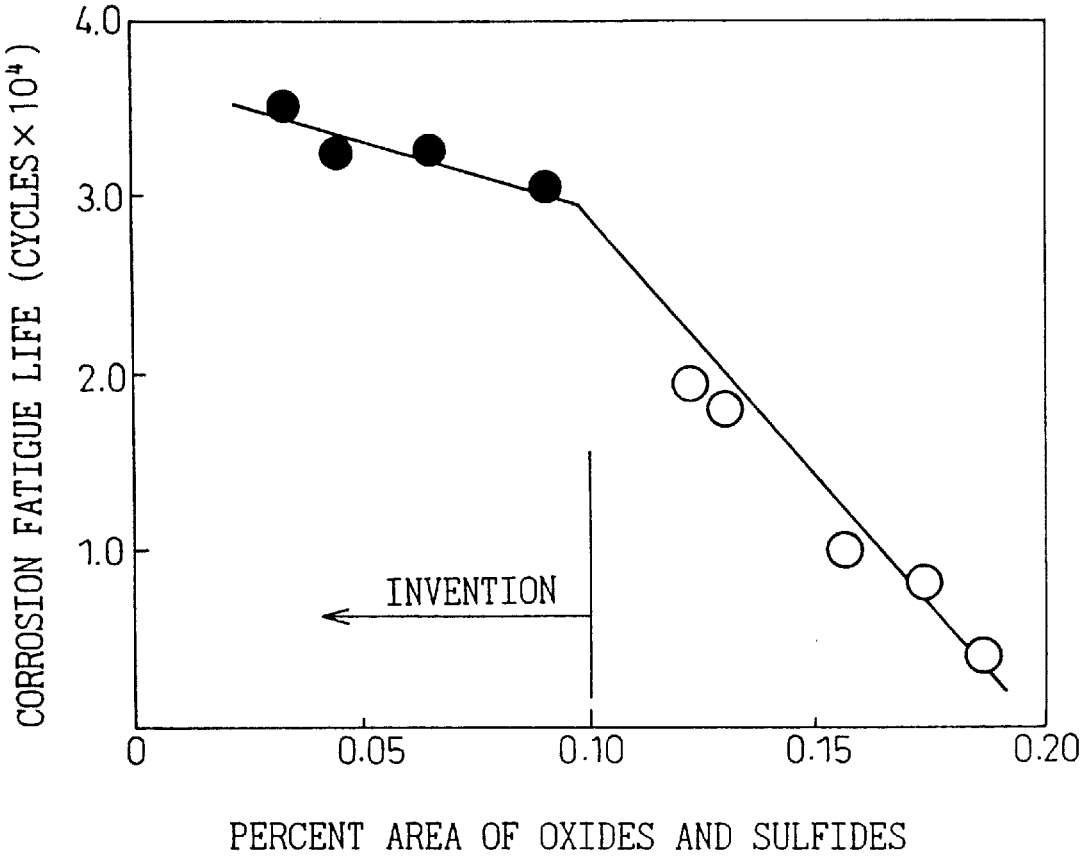
FIG. 13 is a graph showing the relationship between the percent area of oxides and sulfides and the corrosion fatigue life.

FIG. 13 shows the relationship between the percent area of oxides and sulfides and the corrosion fatigue life determined by the number of twisting cycles to fracture at a stress amplitude of 600 MPa. It can be seen from this result that the percent area of oxides and sulfides must not be more than 0.1% in order to ensure a fatigue life of 25000 cycles or more which is generally recognized as an essential requirement for a spring steel. When the percent area is more than 0.1%, the fatigue life is less than 20000 cycles.

Figure 14:
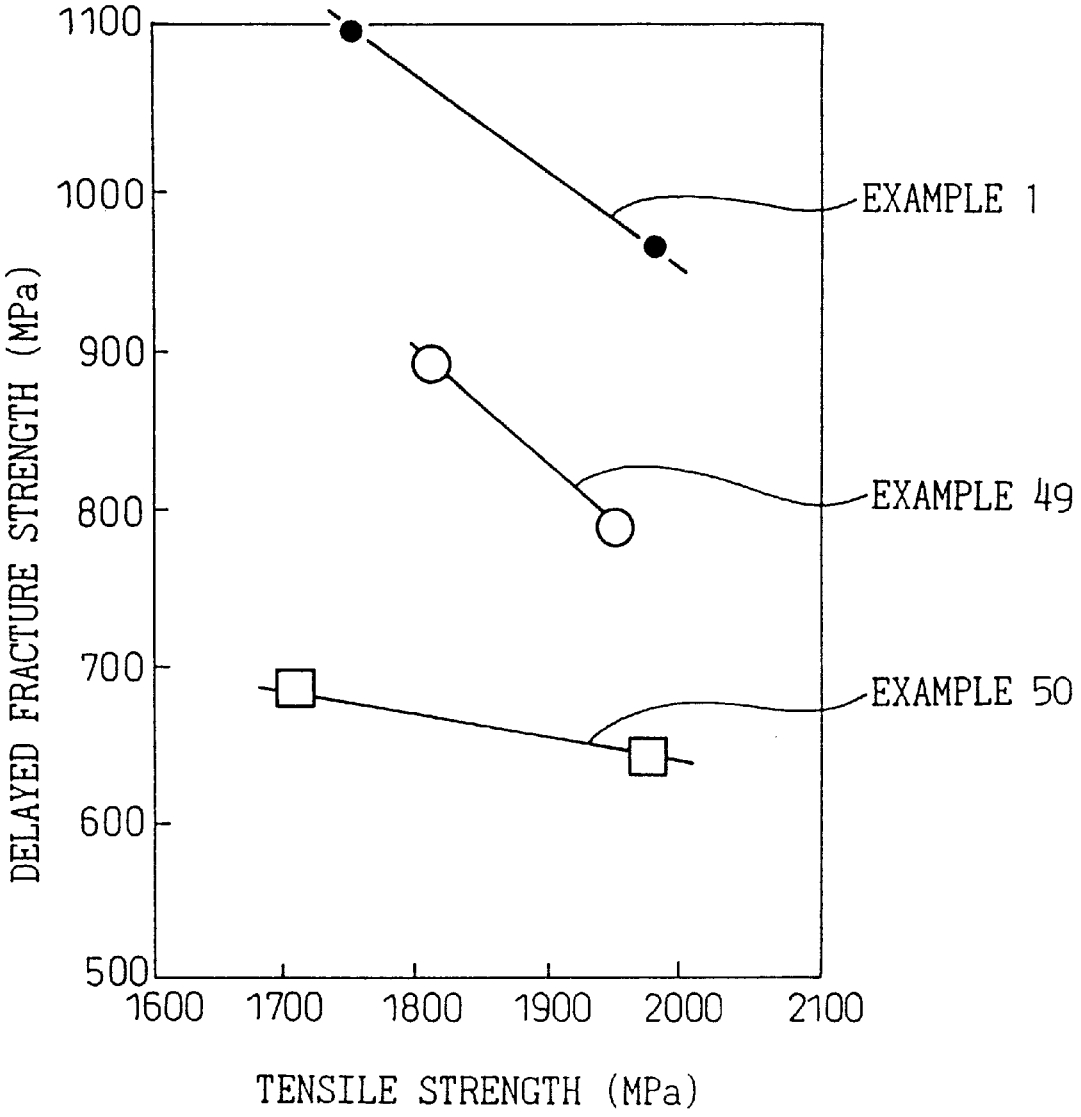
FIG. 14 is a graph showing the relationship between the tensile strength and the delayed fracture strength.

The delayed fracture due to the hydrogen generated during corrosion was also studied. FIG. 14 shows the delayed fracture strength of the inventive sample No. 1 and the comparative samples No. 49 and 50 as a function of the tensile strength. The delayed fracture test was conducted by a hydrogen charging dead weight method in which constant stresses were applied to the test pieces being charged with hydrogen at a current density of 1.0 $mA/cm^2$ in a pH 3 sulfuric acid solution and a maximum stress at which fracture did not occur for 200 hours was determined as a delayed fracture strength. It is generally recognized that the delayed fracture strength is reduced as the tensile strength is increased, At a tensile strength level of 2000 MPa, the present inventive sample exhibited an improved delayed fracture strength close to 1000 MPa in contrast to that of the comparative samples. In FIG. 14, the samples were heat-treated under the previously mentioned basic conditions, except that tempering was conducted at 450° C. and 400° C. for lower and higher tensile strengths, respectively.

Tables 8 and 9 summarize the data for the inventive samples and the comparative samples, respectively, including the tensile strength, the impact toughness, the delayed fracture strength, the fatigue life and the percent area of oxides and sulfides, which were determined by the test in the manner as described above.

It can be seen from the data shown in Tables 8 and 9 that the present invention provides a spring steel with improved properties as follows.

The present inventive steels containing the specified additives of Mg, La and/or Ce have good tensile strength and impact toughness which are comparable to, or better than, those of the comparative steels not containing the specified additives and are practically acceptable as a high strength spring steel.

Moreover, the inventive steels have an improved delayed fracture strength depending on the amounts of the specified additives.

The inventive steels also have an improved corrosion fatigue life, particularly a life of 25000 cycles or more at a stress amplitude of 600 MPa, which advantageously achieves an essential level as a spring steel, which level cannot be achieved by the comparative steels not containing the specified additives.

The specified range of the percent area of oxide and sulfide inclusions of not more than 0.1% is also an essential feature of the present invention to ensure the improved properties as can be seen from Tables 8 and 9. It can be readily recognized that, as can be seen from the comparative samples No. 51 and 53, good fatigue property is not obtained if other specified features are not satisfied although the percent area of oxides and sulfides satisfies the specified range.

As herein described, the present invention uses the addition of Mg, La and/or Ce in the specified amounts to suppress occurrence of local corrosion or formation of corrosion pits, thereby achieving an improved corrosion fatigue property. The N amount is controlled while Ti is added to refine the prior austenite grains and the P and S amounts are limited while B is added to provide an improved cleanness of grain boundaries, so that good ductility, impact toughness and delayed fracture property are achieved at a high strength. The steel quality can be further improved by the addition of elements for improving quench hardenability and/or elements for suppressing decarburization. The present invention thus enables the production of a high strength spring steel having an improved resistance to fracture.

It should be also noted that, according to the present invention, the ductility and the impact toughness are not reduced with the variation in strength, so that the present invention is advantageously applicable to a wider range of the spring strength to enable production of springs having various levels of strength with good reliability.

POSSIBILITY OF UTILIZATION IN THE INDUSTRY

In the steel of the present invention, the austenite grains are refined by adding Ti while N is controlled, and the austenite grain boundaries are cleaned by restricting the contents of P and S, and adding B. The steel of the invention, therefore, has a high ductility and a high impact toughness even when it has a strength as high as exceeding 2,000 MPa.

Moreover, the quality of the steel of the invention can be further improved by adding elements for increasing the quench-hardenability and elements for inhibiting the decarburization. Accordingly, the use of the steel of the present invention makes it possible to produce springs having a high strength and excellent in a fracture property.

Furthermore, since the ductility and impact toughness of the steel of the present invention are not impaired by a change in the strength of the steel, the steel can correspond to springs having a wide range of strength. Accordingly, springs having various strengths can be produced easily without decreasing the reliability.

TABLE 6

| Invention No. | C | Si | Mn | P | S | Cr | Ti | B | N | V | Nb | Ni | Cu | Mo | Mg | La | Ce | Ti/N |
|---|---|---|---|---|---|---|---|---|---|---|---|---|---|---|---|---|---|---|
| 1 | 0.558 | 1.55 | 0.47 | 0.005 | 0.003 | 0.87 | 0.043 | 0.0012 | 0.0029 | — | — | — | — | — | 0.0006 | — | — | 14.8 |
| 2 | 0.530 | 2.07 | 0.37 | 0.012 | 0.005 | 0.57 | 0.056 | 0.0006 | 0.0040 | — | — | — | — | — | 0.0012 | — | — | 14.0 |
| 3 | 0.506 | 1.92 | 0.34 | 0.010 | 0.011 | 0.78 | 0.032 | 0.0016 | 0.0035 | — | — | — | — | — | 0.0023 | — | — | 9.1 |
| 4 | 0.506 | 1.77 | 0.31 | 0.008 | 0.008 | 0.83 | 0.035 | 0.0018 | 0.0044 | — | — | — | — | — | 0.0024 | — | — | 8.0 |
| 5 | 0.529 | 1.86 | 0.32 | 0.012 | 0.010 | 0.55 | 0.033 | 0.0013 | 0.0035 | — | — | — | — | — | — | 0.0019 | — | 9.3 |
| 6 | 0.556 | 2.07 | 0.45 | 0.007 | 0.006 | 0.65 | 0.047 | 0.0006 | 0.0023 | — | — | — | — | — | — | 0.0030 | — | 20.9 |
| 7 | 0.518 | 2.04 | 0.43 | 0.004 | 0.004 | 0.61 | 0.046 | 0.0023 | 0.0035 | — | — | — | — | — | — | 0.0052 | — | 13.1 |
| 8 | 0.523 | 1.65 | 0.29 | 0.009 | 0.005 | 0.60 | 0.035 | 0.0014 | 0.0039 | — | — | — | — | — | — | — | 0.0020 | 9.1 |
| 9 | 0.552 | 2.01 | 0.32 | 0.012 | 0.008 | 0.80 | 0.042 | 0.0011 | 0.0026 | — | — | — | — | — | — | — | 0.0045 | 16.4 |
| 10 | 0.534 | 1.96 | 0.48 | 0.01 | 0.007 | 0.76 | 0.031 | 0.0028 | 0.0029 | — | — | — | — | — | — | — | 0.0065 | 10.7 |
| 11 | 0.514 | 1.65 | 0.29 | 0.006 | 0.006 | 0.51 | 0.030 | 0.0016 | 0.0031 | — | — | — | — | — | 0.0019 | — | — | 9.7 |
| 12 | 0.517 | 2.07 | 0.28 | 0.010 | 0.012 | 0.57 | 0.066 | 0.0018 | 0.0034 | — | — | — | — | — | 0.0022 | — | — | 19.1 |
| 13 | 0.506 | 2.44 | 0.35 | 0.005 | 0.009 | 0.54 | 0.040 | 0.0005 | 0.0035 | 0.095 | — | — | — | — | 0.0026 | — | — | 11.4 |
| 14 | 0.525 | 2.42 | 0.21 | 0.007 | 0.009 | 1.21 | 0.046 | 0.0006 | 0.0028 | — | — | — | — | — | 0.0011 | — | — | 16.4 |
| 15 | 0.531 | 1.86 | 0.29 | 0.005 | 0.012 | 0.61 | 0.020 | 0.0007 | 0.0049 | — | — | 0.502 | — | — | 0.0005 | — | — | 4.2 |
| 16 | 0.524 | 2.18 | 0.49 | 0.01 | 0.009 | 0.60 | 0.047 | 0.0015 | 0.0054 | — | — | — | — | 0.121 | 0.0026 | — | — | 8.6 |
| 17 | 0.536 | 2.08 | 0.35 | 0.009 | 0.009 | 0.53 | 0.030 | 0.0025 | 0.0025 | — | 0.045 | — | — | — | 0.0023 | — | — | 11.8 |
| 18 | 0.556 | 2.46 | 0.37 | 0.005 | 0.006 | 0.52 | 0.046 | 0.0019 | 0.0049 | 0.298 | — | — | — | — | 0.0009 | — | — | 9.5 |
| 19 | 0.503 | 1.62 | 0.55 | 0.007 | 0.007 | 0.77 | 0.038 | 0.0017 | 0.0036 | — | — | — | — | — | 0.0029 | — | — | 10.4 |
| 20 | 0.465 | 1.97 | 0.29 | 0.006 | 0.005 | 0.65 | 0.016 | 0.0014 | 0.0026 | — | — | — | — | — | 0.0015 | — | — | 6.3 |
| 21 | 0.602 | 2.27 | 0.40 | 0.006 | 0.012 | 0.65 | 0.028 | 0.0021 | 0.0028 | 0.131 | — | | | 0.512 | 0.0013 | — | — | 10.0 |
| 22 | 0.721 | 1.68 | 0.48 | 0.006 | 0.012 | 0.80 | 0.035 | 0.0009 | 0.0051 | — | — | | | | 0.0019 | — | — | 6.8 |
| 23 | 0.529 | 1.62 | 0.30 | 0.008 | 0.011 | 0.63 | 0.056 | 0.0011 | 0.0032 | 0.112 | — | | | 0.197 | 0.0014 | — | — | 17.5 |
| 24 | 0.509 | 2.08 | 0.49 | 0.003 | 0.004 | 0.58 | 0.047 | 0.0006 | 0.0050 | 0.121 | — | 0.428 | | 0.102 | 0.0006 | — | — | 9.3 |
| 25 | 0.555 | 2.33 | 0.35 | 0.011 | 0.008 | 0.87 | 0.039 | 0.0017 | 0.0025 | — | — | 0.51 | 0.42 | — | 0.0012 | — | — | 15.2 |
| 26 | 0.51 | 2.24 | 0.22 | 0.008 | 0.012 | 0.83 | 0.042 | 0.0018 | 0.0043 | — | — | — | 0.21 | — | 0.0021 | — | — | 9.8 |
| 27 | 0.502 | 1.97 | 0.75 | 0.009 | 0.012 | 0.80 | 0.043 | 0.0005 | 0.0029 | — | — | — | — | — | 0.0048 | — | — | 14.7 |

TABLE 7

| Comparison No. | C | Si | Mn | P | S | Cr | Ti | B | N | V | Nb | Ni | Cu | Mo | Mg | La | Ce | Ti/N |
|---|---|---|---|---|---|---|---|---|---|---|---|---|---|---|---|---|---|---|
| 28 | 0.53 | 1.52 | 0.65 | 0.013 | 0.013 | 0.75 | — | — | 0.0047 | — | — | — | — | — | — | — | — | 0 |
| 29 | 0.555 | 1.66 | 0.75 | 0.011 | 0.010 | 0.62 | — | — | 0.0045 | 0.102 | — | — | — | — | — | — | — | 0 |
| 30 | 0.506 | 1.65 | 0.70 | 0.005 | 0.011 | 1.09 | — | — | 0.0052 | — | — | — | — | — | — | — | — | 0 |
| 31 | 0.547 | 1.72 | 0.65 | 0.009 | 0.008 | 0.88 | — | — | 0.0052 | — | — | 0.382 | — | — | — | — | — | 0 |
| 32 | 0.554 | 1.92 | 0.72 | 0.011 | 0.012 | 0.63 | — | — | 0.0029 | — | — | — | — | 0.155 | — | — | — | 0 |
| 33 | 0.559 | 1.83 | 0.65 | 0.003 | 0.009 | 0.75 | — | — | 0.0038 | — | 0.0045 | — | — | — | — | — | — | 0 |
| 34 | 0.538 | 2.15 | 0.84 | 0.005 | 0.008 | 0.72 | 0.045 | 0.0012 | 0.0035 | — | — | — | — | — | — | — | — | 13.0 |
| 35 | 0.547 | 1.73 | 0.78 | 0.009 | 0.011 | 0.83 | 0.030 | 0.0006 | 0.0039 | — | — | — | — | — | — | — | — | 7.6 |
| 36 | 0.514 | 1.61 | 0.73 | 0.005 | 0.016 | 0.68 | 0.036 | 0.0016 | 0.0027 | — | — | — | — | — | — | — | — | 13.3 |
| 37 | 0.518 | 2.18 | 0.81 | 0.009 | 0.016 | 0.58 | 0.050 | 0.0023 | 0.0029 | — | — | — | — | — | — | — | — | 17.1 |
| 38 | 0.539 | 1.85 | 0.26 | 0.009 | 0.026 | 0.85 | 0.031 | 0.0008 | 0.0045 | — | — | — | — | — | — | — | — | 7.0 |
| 39 | 0.508 | 1.71 | 0.43 | 0.003 | 0.006 | 0.54 | 0.025 | 0.0015 | 0.0043 | — | — | — | — | — | — | — | — | 5.8 |
| 40 | 0.516 | 2.06 | 0.24 | 0.010 | 0.011 | 0.85 | 0.030 | 0.0018 | 0.0039 | 0.135 | — | — | — | — | — | — | — | 7.7 |
| 41 | 0.505 | 2.45 | 0.24 | 0.012 | 0.007 | 1.10 | 0.033 | 0.0025 | 0.0051 | — | — | — | — | — | — | — | — | 6.4 |
| 42 | 0.520 | 1.66 | 0.37 | 0.003 | 0.006 | 0.61 | 0.020 | 0.0022 | 0.0043 | — | — | 0.456 | — | — | — | — | — | 4.7 |
| 43 | 0.532 | 1.68 | 0.35 | 0.011 | 0.008 | 0.53 | 0.032 | 0.0019 | 0.0035 | — | — | — | — | 0.116 | — | — | — | 9.1 |
| 44 | 0.501 | 2.07 | 0.27 | 0.011 | 0.012 | 0.54 | 0.024 | 0.0018 | 0.0034 | — | 0.051 | — | — | — | — | — | — | 7.1 |
| 45 | 0.555 | 2.49 | 0.98 | 0.009 | 0.008 | 0.63 | 0.034 | 0.0019 | 0.0044 | — | — | — | — | — | — | — | — | 7.7 |
| 46 | 0.462 | 1.78 | 0.79 | 0.008 | 0.019 | 0.82 | 0.013 | 0.0017 | 0.0033 | — | — | — | — | — | — | — | — | 4.0 |
| 47 | 0.611 | 2.41 | 0.78 | 0.007 | 0.009 | 0.73 | 0.038 | 0.0018 | 0.0044 | — | — | — | — | — | — | — | — | 8.7 |
| 48 | 0.713 | 1.53 | 0.71 | 0.005 | 0.005 | 0.69 | 0.028 | 0.0017 | 0.0046 | — | — | — | — | — | — | — | — | 6.2 |
| 49 | 0.58 | 1.79 | 0.99 | 0.015 | 0.014 | 0.72 | 0.020 | 0.002 | 0.0035 | — | — | — | — | — | — | — | — | 5.7 |
| 50 | 0.532 | 1.72 | 0.65 | 0.010 | 0.026 | 0.67 | 0.047 | 0.0021 | 0.0027 | 0.09 | — | — | — | 0.098 | — | — | — | 17.4 |
| 51 | 0.508 | 1.59 | 0.50 | 0.026 | 0.012 | 0.56 | 0.047 | 0.0024 | 0.0038 | — | — | — | — | — | 0.0025 | — | — | 12.4 |
| 52 | 0.543 | 2.04 | 0.33 | 0.011 | 0.028 | 0.64 | 0.044 | 0.0012 | 0.0045 | — | — | — | — | — | 0.0015 | — | — | 9.7 |
| 53 | 0.514 | 2.41 | 0.49 | 0.009 | 0.007 | 0.72 | 0.029 | — | 0.0047 | — | — | — | — | — | 0.0021 | — | — | 6.3 |
| 54 | 0.58 | 2.01 | 0.75 | 0.026 | 0.014 | 0.73 | 0.024 | — | 0.0042 | — | — | — | — | — | — | — | — | 5.7 |

TABLE 8

| No. | Tensile strength (MPa) | Impact toughness (kgf-m/cm$^2$) | Delayed fracture strength (MPa) | Fatigue life (cycles × $10^4$) | Percent area of oxides and sulfides |
|---|---|---|---|---|---|
| Invention | | | | | |
| 1 | 1915 | 5.1 | 968 | 3.1 | 0.081 |
| 2 | 1933 | 5.5 | 994 | 3.2 | 0.063 |
| 3 | 1884 | 6.1 | 1004 | 3.2 | 0.046 |
| 4 | 1928 | 6.0 | 961 | 3.5 | 0.038 |
| 5 | 1964 | 5.1 | 959 | 3.2 | 0.076 |
| 6 | 1916 | 6.1 | 960 | 3.1 | 0.059 |
| 7 | 1938 | 5.8 | 942 | 3.5 | 0.046 |
| 8 | 1935 | 6.2 | 947 | 3.3 | 0.061 |
| 9 | 1868 | 5.9 | 1012 | 3.3 | 0.044 |
| 10 | 1921 | 5.6 | 972 | 3.2 | 0.050 |
| 11 | 1997 | 5.6 | 934 | 3.1 | 0.091 |
| 12 | 1929 | 6.7 | 932 | 3.2 | 0.057 |
| 13 | 1896 | 6.0 | 973 | 3.5 | 0.032 |
| 14 | 1905 | 5.5 | 987 | 3.5 | 0.034 |
| 15 | 1960 | 6.3 | 923 | 3.4 | 0.052 |
| 16 | 1985 | 6.4 | 1000 | 3.4 | 0.050 |
| 17 | 1948 | 6.4 | 881 | 3.3 | 0.071 |
| 18 | 1913 | 5.6 | 918 | 3.6 | 0.070 |
| 19 | 1986 | 5.7 | 930 | 3.4 | 0.030 |
| 20 | 1934 | 6.2 | 1014 | 3.1 | 0.065 |
| 21 | 1885 | 6.7 | 1050 | 3.5 | 0.055 |
| 22 | 1966 | 6.5 | 929 | 3.3 | 0.066 |
| 23 | 1893 | 6.8 | 967 | 3.5 | 0.050 |
| 24 | 1949 | 5.3 | 880 | 3.6 | 0.064 |
| 25 | 1953 | 5.2 | 1003 | 3.5 | 0.061 |
| 26 | 1938 | 6.0 | 890 | 3.3 | 0.030 |
| 27 | 1922 | 6.0 | 1008 | 3.1 | 0.090 |

TABLE 9

| No. | Tensile strength (MPa) | Impact toughness (kgf-m/cm$^2$) | Delayed fracture strength (MPa) | Fatigue life (cycles × $10^4$) | Percent area of oxides and sulfides |
|---|---|---|---|---|---|
| Comparison | | | | | |
| 28 | 1972 | 2.7 | 614 | 0.5 | 0.120 |
| 29 | 1960 | 2.4 | 665 | 1.1 | 0.149 |
| 30 | 1870 | 2.8 | 626 | 0.8 | 0.100 |
| 31 | 1870 | 2.9 | 678 | 0.4 | 0.137 |
| 32 | 1930 | 2.6 | 702 | 1.2 | 0.143 |
| 33 | 1892 | 2.9 | 653 | 1.3 | 0.146 |
| 34 | 1978 | 5.4 | 949 | 1.8 | 0.120 |
| 35 | 1969 | 5.6 | 797 | 1.6 | 0.125 |
| 36 | 1966 | 5.3 | 788 | 0.9 | 0.155 |
| 37 | 1910 | 5.9 | 804 | 0.8 | 0.170 |
| 38 | 1919 | 5.1 | 696 | 0.3 | 0.188 |
| 39 | 1949 | 5.4 | 687 | 1.1 | 0.121 |
| 40 | 1861 | 6.1 | 895 | 1.1 | 0.111 |
| 41 | 1902 | 5.2 | 827 | 2.0 | 0.169 |
| 42 | 1916 | 5.1 | 814 | 1.5 | 0.199 |
| 43 | 1886 | 6.0 | 830 | 1.4 | 0.107 |
| 44 | 1914 | 5.3 | 884 | 2.1 | 0.133 |
| 45 | 1986 | 6.7 | 807 | 1.1 | 0.152 |
| 46 | 1901 | 5.4 | 823 | 1.9 | 0.196 |
| 47 | 1945 | 6.7 | 830 | 1.3 | 0.177 |
| 48 | 1950 | 5.3 | 896 | 1.8 | 0.105 |
| 49 | 1951 | 5.1 | 786 | 0.9 | 0.138 |
| 50 | 1884 | 6.3 | 862 | 0.3 | 0.197 |
| 51 | 1962 | 3.4 | 646 | 0.5 | 0.088 |
| 52 | 1869 | 2.7 | 678 | 0.9 | 0.130 |
| 53 | 1901 | 2.4 | 840 | 1.5 | 0.075 |
| 54 | 1922 | 4.8 | 625 | 1.0 | 0.137 |

TABLE 10

| Step | Conditions |
|---|---|
| Rolling | Heating 950–1250° C. 50–90 min<br>Coiling temp. 800–930° C.<br>Rolled size ϕ15–17 mm |
| Heat treatment | Quench hardening 900° C. × 15 min → OQ<br>Tempering 300–500° C. × 30 min → AC |
| Tensile test | Based on JIS Z 2241, Gauge ϕ9 mm |
| Impact test | Based on JIS Z 2242, JIS No. 3 charpy impact test, Testing temp.: 25° C. (room temp.) |
| Delayed fracture test | Hydrogen charged, Dead weight test, Gauge ϕ8 mm, Notch depth 1 mm |
| Twist fatigue test | Gauge ϕ6 mm, After 20 cycles of corrosion |

What is claimed is:

1. A high toughness spring steel comprising, based on mass, 0.45 to 0.85% C, 0.9 to 2.5% Si, 0.1 to 1.2% Mn, 0.1 to 2.0% Cr, 0.005 to 0.07% Ti, 0.001 to 0.007% N, the Ti content being greater than four times the N content, 0.0005 to 0.0060% B, 0.0005 to 0.01% Mg, P and S with respective contents of less than 0.020% and 0.020%, and the balance of Fe and unavoidable impurities, and percent area of oxides and sulfides being not more than 0.1%.

2. A high toughness spring steel according to claim 1, wherein the upper limit of the Mg content is 0.003%.

3. A high toughness spring steel according to claim 1 or 2, further comprising one or two of 0.05 to 0.5% V and 0.01 to 0.10% Nb.

4. A high toughness spring steel according to claim 1 or 2, further comprising one or two of 0.05 to 1.0% Ni and 0.05 to 1.0% Mo.

5. A high toughness spring steel according to claim 1 or 2, further comprising one or two of 0.05 to 0.5% V and 0.01 to 0.10% Nb and one or two of 0.05 to 1.0% Ni and 0.05 to 1.0% Mo.

6. A high toughness spring steel according to claim 1 or 2, further comprising 0.05 to 0.3% Cu.

7. A high toughness spring steel according to claim 1 or 2, further comprising 0.05 to 0.5% Cu and 0.05 to 1.0% Ni, the Cu content being less than the Ni content provided that the Cu content is greater than 0.3%.

8. A high toughness spring steel according to claim 6, further comprising one or two of 0.05 to 0.5% V and 0.01 to 0.10% Nb.

9. A high toughness spring steel according to claim 7, further comprising one or two of 0.05 to 0.5% V and 0.01 to 0.10% Nb.

10. A high toughness spring steel according to claim 6, further comprising 0.05 to 1.0% Mo.

11. A high toughness spring steel according to claim 7, further comprising 0.05 to 1.0% Mo.

12. A high toughness spring steel according to claim 6, further comprising 0.05 to 1.0% Mo and one or two of 0.05 to 0.5% V and 0.01 to 0.10% Nb.

13. A high toughness spring steel according to claim 7, further comprising 0.05 to 1.0% Mo and one or two of 0.05 to 0.5% V and 0.01 to 0.10% Nb.

* * * * *